US007048702B2

(12) United States Patent
Hui

(10) Patent No.: US 7,048,702 B2
(45) Date of Patent: May 23, 2006

(54) EXTERNAL COUNTERPULSATION AND METHOD FOR MINIMIZING END DIASTOLIC PRESSURE

(75) Inventor: John C. K. Hui, East Setauket, NY (US)

(73) Assignee: Vasomedical, Inc., Westbury, NY (US)

( * ) Notice: Subject to any disclaimer, the term of this patent is extended or adjusted under 35 U.S.C. 154(b) by 280 days.

(21) Appl. No.: 10/190,317

(22) Filed: Jul. 3, 2002

(65) Prior Publication Data

US 2003/0233061 A1 Dec. 18, 2003

Related U.S. Application Data

(60) Provisional application No. 60/388,212, filed on Jun. 13, 2002.

(51) Int. Cl.
*A61H 9/00* (2006.01)

(52) U.S. Cl. ..... 601/152; 601/150; 606/201

(58) Field of Classification Search ..... 601/148, 601/149, 150, 151, 152, 41, 44; 606/201, 606/202, 203, 204; 600/311; 128/DIG. 20, 128/898

See application file for complete search history.

(56) References Cited

U.S. PATENT DOCUMENTS

| | | | |
|---|---|---|---|
| 2,230,068 | A | 1/1941 | Roensch |
| 2,249,579 | A | 7/1941 | Rea |
| 2,361,242 | A | 10/1944 | Rosett |
| 2,528,843 | A | 11/1950 | Poor |
| 2,533,504 | A | 12/1950 | Poor |
| 2,543,284 | A | 2/1951 | Gleason |
| 2,674,231 | A | 4/1954 | Erickson |
| 2,694,395 | A | 11/1954 | Brown |
| 2,747,570 | A | 5/1956 | Jobst |
| 3,063,444 | A | 11/1962 | Jobst |
| 3,094,116 | A | 6/1963 | Logan et al. |

(Continued)

FOREIGN PATENT DOCUMENTS

DE 25 44 299 4/1977

(Continued)

OTHER PUBLICATIONS

E.S. Bucherl et al., Counterpulsation: Foundation and Future, with a Tribute to William Clifford Birtwell (1916-1978), pp. 20-23.

(Continued)

*Primary Examiner*—Quang D. Thanh
(74) *Attorney, Agent, or Firm*—Harness, Dickey & Pierce, P.L.C.

(57) ABSTRACT

An external counterpulsation apparatus and method for minimizing end diastolic pressure includes a fluid distribution assembly interconnecting a plurality of inflatable devices adapted to be received about the lower extremities of the patient and a source of compressed fluid to be distributed by the fluid distribution assembly to the inflatable devices. The controller in communication with the fluid distribution assembly controls inflation and deflation of the inflatable devices to minimize end diastolic pressure. The controller controls deflation of the inflatable devices without reducing venous return and then minimizes energy spent in ventricular isovolumetric contraction. Further, the controller controls inflation of the inflatable devices to inflate a distal inflatable device prior to inflating a proximal inflatable device. Further, the controller controls a plurality of inflation functions including rate of pressure applied, the magnitude of pressure applied, the duration of time that external pressure is applied, and the duration of time to deflate the inflatable devices.

17 Claims, 9 Drawing Sheets

U.S. PATENT DOCUMENTS

| | | | |
|---|---|---|---|
| 3,179,106 | A | 4/1965 | Meredith |
| 3,303,841 | A | 2/1967 | Dennis |
| 3,403,673 | A | 10/1968 | MacLeod |
| 3,483,862 | A | 12/1969 | Takeuchi |
| 3,548,809 | A | 12/1970 | Conti |
| 3,654,919 | A | 4/1972 | Birtwell |
| 3,659,593 | A | 5/1972 | Vail |
| 3,712,290 | A | 1/1973 | Irnich et al. |
| 3,734,087 | A | 5/1973 | Sauer et al. |
| 3,783,859 | A | 1/1974 | Sauer et al. |
| 3,786,802 | A | 1/1974 | Hagopian et al. |
| 3,795,242 | A | 3/1974 | Lerch et al. |
| 3,835,845 | A | 9/1974 | Maher |
| 3,859,989 | A | 1/1975 | Spielberg |
| 3,862,629 | A | 1/1975 | Rotta |
| 3,865,103 | A | 2/1975 | Folman |
| 3,866,604 | A | 2/1975 | Curless et al. |
| 3,878,839 | A | 4/1975 | Norton et al. |
| 3,892,229 | A | 7/1975 | Taylor et al. |
| 3,901,221 | A | 8/1975 | Nicholson et al. |
| 3,942,518 | A | 3/1976 | Tenteris et al. |
| 3,961,625 | A | 6/1976 | Dillon |
| 3,970,076 | A | 7/1976 | Hepp et al. |
| 3,976,056 | A | 8/1976 | Brawn |
| 4,013,069 | A | 3/1977 | Hasty |
| 4,030,488 | A | 6/1977 | Hasty |
| 4,077,402 | A | 3/1978 | Benjamin, Jr. et al. |
| 4,080,958 | A | 3/1978 | Bregman et al. |
| 4,091,804 | A | 5/1978 | Hasty |
| 4,135,496 | A | 1/1979 | Chazov et al. |
| 4,253,449 | A | 3/1981 | Arkans et al. |
| 4,269,175 | A | 5/1981 | Dillon |
| 4,343,302 | A | 8/1982 | Dillon |
| 4,388,919 | A | 6/1983 | Benjamin, Jr. et al. |
| 4,454,494 | A | 6/1984 | Williams et al. |
| 4,481,937 | A | 11/1984 | Arkans |
| 4,590,925 | A | 5/1986 | Dillon |
| 4,738,249 | A | 4/1988 | Linman et al. |
| 4,753,226 | A | 6/1988 | Zheng et al. |
| 4,971,042 | A | 11/1990 | Lerman |
| 5,000,164 | A | 3/1991 | Cooper |
| 5,090,417 | A | 2/1992 | Mollan et al. |
| 5,095,912 | A | 3/1992 | Tomita |
| 5,109,832 | A | 5/1992 | Proctor et al. |
| 5,245,990 | A | 9/1993 | Bertinin |
| 5,429,584 | A | 7/1995 | Chiu |
| 5,443,440 | A | 8/1995 | Tumey et al. |
| 5,487,722 | A | 1/1996 | Weaver, II et al. |
| 5,490,820 | A | 2/1996 | Schock et al. |
| 5,514,079 | A | 5/1996 | Dillon |
| 5,554,103 | A | 9/1996 | Zheng et al. |
| 5,571,075 | A | 11/1996 | Bullard |
| 5,840,049 | A | 11/1998 | Tumey et al. |
| 5,891,012 | A | 4/1999 | Downey et al. |
| 5,891,062 | A | 4/1999 | Schock et al. |
| 5,951,502 | A | 9/1999 | Peeler et al. |
| 5,997,540 | A | 12/1999 | Zheng et al. |
| 6,120,431 | A | 9/2000 | Magovern et al. |
| 6,132,363 | A | 10/2000 | Freed et al. |
| 6,144,880 | A | 11/2000 | Ding et al. |
| 6,161,038 | A | 12/2000 | Schookin et al. |
| 6,355,008 | B1 | 3/2002 | Nakao |
| 6,371,123 | B1 | 4/2002 | Stark et al. |
| 2001/0018563 | A1 | 8/2001 | Waldridge et al. |
| 2001/0027279 | A1 | 10/2001 | Rothman et al. |
| 2002/0173735 | A1 | 11/2002 | Lewis |

FOREIGN PATENT DOCUMENTS

| | | |
|---|---|---|
| EP | 0203310 | 3/1986 |
| FR | 1562252 | 2/1969 |
| JP | 11-19145 | 1/1999 |
| WO | WO 99/08644 | 2/1999 |

OTHER PUBLICATIONS

W. Birtwell et al., Transactions—American Society for Artificial Internal Organs, vol. XI, 1965, pp. 43-51.

Lawrence S. Cohen, MD, FACC, et al., Sequenced External Counterpulsation and Intraaortic Balloon Pumping in Cardiogenic Shock, Oct. 1973, The American Journal of Cardiology, vol. 32, pp. 656-661.

W. C. Birtwell et al., The Present Status of External Counterpulsation, 1979, pp. 71-78.

Juan Lin et al., An Analytical Approach to the Determination of Optimal Phasing for External Counterpulsation, Journal of Bioengineering vol. 2, 1978, pp. 167-175.

Zhen-sheng Zbeng et al., Sequential External Counterpulsation (SECP) in China, Transactions of the American Society Artificial Internal Organs, 1983; 29: 599-603.

William E. Lawson, MD et al., Enhanced External Counterpulsation for Chronic Myocardial Ischemia, The Journal of Critical Illness, vol. 15, No. 11, Nov. 2000.

William E. Lawson et al., Treatment Benefit in the Enhanced External Counterpulsation Consortium, General Cardiology, Cardiology 2000; 94:31-35.

The Journal of Heart Disease, Abstracts, May 1999, vol. 1, No. 1, 4 Pages.

Supplement to Journal of the American College of Cardiology, 49th Annual Scientific Session, Feb. 2000, 2 Pages.

Program & Abstracts, The Endocrine Society's 82nd Annual Meeting, Jun. 21-24, 2000, 2 Pages.

Jay N. Cohn, Supplement to Journal of Cardiac Failure, vol. 6, No. 3, Sep. 2000, 4 Pages.

Abstracts from Scientific Sessions 2000, Supplement to Journal of the American Heart Association, Nov. 12-15, 2000, 2 Pages.

British Cardiac Society Annual Conference, May 2001, vol. 85, Supplement 1, 3 Pages.

Hisashi Urano, MD et al., Enhanced External Counterpulsation Improves Exercise Tolerance, Journal of the American College of Cardiology, Jan. 2001, vol. 37, No. 1, pp. 93-97.

William E. Lawson, MD et al., Enhanced External Counterpulsation for Chronic Myocardial Ischemia, Critical Procedures: No. 138, The Journal of Critical Illness, vol. 15, Issue 11, Nov. 2000, 8 Pages.

Ozlem Soran, MD et al., Enhanced External Counterpulsation in the Management of Patients with Cardiovascular Disease, Clin. Cardiol. 22, 173-178 (1999).

PCT International Search Report, PCT/US03/18425—filed Jun. 11, 2003.

EXTERNAL COUNTERPULSATION AND METHOD FOR MINIMIZING END DIASTOLIC PRESSURE

CROSS-REFERENCE TO RELATED APPLICATIONS

This application claims the benefit of U.S. Provisional Application No. 60/388,212, filed Jun. 13, 2002.

FIELD OF THE INVENTION

The present invention relates to an external counterpulsation apparatus and method for controlling the same, and more particularly, to such an external counterpulsation apparatus and method for controlling the same having improved efficiency and utility.

DISCUSSION OF THE INVENTION

External counterpulsation is a noninvasive, atraumatic means for assisting and increasing circulation in patients. External counterpulsation uses the patient's physiological signals related to their heart cycle (e.g., electrocardiograph (ECG)), blood pressure, blood flow) to modulate the inflation and deflation timing of sets of compressive cuffs wrapped around a patient's calves, lower thighs and/or upper thighs, including the lower buttocks. The cuffs inflate to create a retrograde arterial pressure wave and, at the same time, push venous blood return from the extremities to reach the heart at the onset of diastole. The result is augmented diastolic central aortic pressure and increased venous return. Rapid, simultaneous deflation of the cuffs produces systolic unloading and decreased cardiac workload. The end results are increased perfusion pressure to the coronary artery during diastole, when the heart is in a relaxed state with minimal resistant to blood flow; reduced systolic pressure due to the "sucking effect" during cuff deflation; and increased cardiac output due to increased venous return and reduced systolic pressure.

Under normal operating conditions, when the heart contracts and ejects blood during systole, the aortic and coronary perfusion pressure increases. It should also be noted that the workload of the heart is proportional to the systolic pressure. However, during systole the impedance to coronary flow also increases significantly due to the contracting force of the myocardium, thereby restricting coronary blood flow. Also, during diastole, the myocardium is in a relaxed state, and impedance to coronary flow is significantly reduced. Consequently, although the diastolic perfusion pressure is much lower than systolic pressure, the coronary blood flow during diastole accounts for approximately eighty (80) percent of the total flow.

The traditional objectives of external counterpulsation are to minimize systolic and maximize diastolic pressures. These objectives coalesce to improve the energy demand and supply ratio. For example, in the case of patients with coronary artery disease, energy supply to the heart is limited. External counterpulsation can be effective in improving cardiac functions for these patients by increasing coronary blood flow and therefore energy supply to the heart.

During a treatment session, the patient lies on a table. Electronically controlled inflation and deflation valves are connected to multiple pairs of inflatable devices, typically adjustable cuffs that are wrapped firmly, but comfortably, around the patient's calves, lower thighs, and/or upper thighs, including the buttocks. The design of the cuffs permits significant compression of the arterial and venous vasculature at relative low pneumatic pressures (200–350 millimeters Hg).

An earlobe pulse wave, finger pulse wave or temporal pulse wave is often used as a timing signal to give the appropriate time for application of the external pressure so that the resulting pulse produced by external pressure in the artery can arrive at the root of the aorta just at the closure of the aortic valve. Thus, the arterial pulse wave is divided into a systolic period and a diastolic period. The earlobe pulse wave, finger pulse wave or temporal pulse wave signals, however, may not reflect the true pulse wave from the great arteries such as the aorta.

External counterpulsation treatments and devices are described in the art, including U.S. Pat. No. 3,303,841, Dennis, issued Feb. 14, 1967; U.S. Pat. No. 3,403,673, MacLeod, issued Oct. 1, 1968; U.S. Pat. No. 3,654,919, Birtwell, issued Apr. 11, 1972; U.S. Pat. No. 3,866,604, Curless et al., issued Feb. 18, 1975; U.S. Pat. No. 4,753,226, Zheng et al., issued Jun. 28, 1988; U.S. Pat. No. 5,554,103, Zheng et al., issued Sep. 10, 1996; U.S. Pat. No. 5,997,540, Zheng et al., issued Dec. 7, 1999; PCT Application WO 99/08644, Shabty et al., published Feb. 25, 1999; Zheng et al., "Sequential External Counterpulsation (SECP) in China," *Transactions of the American Society of Artificial External Organs,* 29:599–603 (1983); Soroff, et al., "Historical Review of the Development of Enhanced External Counterpulsation Therapy and its Physiologic Rationale," *Cardiovascular Reviews & Reports* (1997); Stroebeck et al., "The Emerging Role of Enhanced External Counterpulsation in Cardiovascular Disease Management," *Cardiovascular Reviews & Reports* (1997); Chou, "Enhanced External Counterpulsation," *ACC Educational Highlights* (1998); Arora, et al., "The Multicenter Study of Enhanced External Counterpulsation (MUST-EECP): Effect of EECP on Exercise-Induced Myocardial Ischemia and Anginal Episodes," *J. Am. Coll. Cardiology,* 33:No. 7 (1999); and Soran et al., "Enhanced External Counterpulsation in the Management of Patients with Cardiovascular Disease," *Clin. Cardiol.* 22:173–178 (1999).

According to the present invention, there are two factors that should be taken into account to determine the appropriate deflation time of the inflatable devices: (1) release of all external pressure before the next systole to produce maximal systolic unloading, i.e., the maximum reduction of systolic pressure; (2) maintenance of the inflation as long as possible to fully utilize the whole period of diastole so as to produce the longest possible diastolic augmentation, i.e., the increase of diastolic pressure due to externally applied pressure. One measurement of effective counterpulsation is the ability to minimize systolic pressure, and at the same time maximize the ratio of the area under the diastolic waveform to that of the area under the systolic waveform. This consideration can be used to provide a guiding rule for determination of optimal deflation time.

The external counterpulsation system and method for minimizing end diastolic pressure by monitoring and controlling certain hemodynamic effects according to the invention improves a patient's cardiac function. An external counterpulsation apparatus for treating a patient includes inflatable devices received about the lower extremities of the patient and connected to a source of compressed fluid. A fluid distribution assembly distributes compressed fluid from the source to the inflatable devices. A controller controls the fluid distribution assembly to inflate and deflate the inflatable devices to minimize end diastolic pressure and minimize energy spent in ventricular isovolumetric contraction. In this manner, increased cardiac output is achieved.

Moreover, an external counterpulsation apparatus and method for treating a patient by compressing the patient's vascular bed and generating a pulse traveling the patient's arterial tree to the root of the aorta includes controlling the fluid distribution assembly and inflation and deflation of the inflatable devices to inflate the distal inflatable device prior to inflating the proximal inflatable device. For timing purposes, the distal inflatable device is inflated at a time allowing a pulse generated by subsequent application of the proximal inflatable device to compress the vascular bed travels up the arterial tree and reaches the root at the aorta when the aortic valve closes. In one implementation, the proximal inflatable device is inflated beginning at a time delay after the distal inflatable device is inflated. The time delay corresponds to a length of time that a peak of the pulse generated by inflating the distal inflatable device reaches a midpoint of the proximal inflatable device. The distal inflatable device may be such that the distal retrograde pulse arrives at the root of the aorta at approximately twenty-five (25) to fifty (50) percent of a pulse amplitude from end diastole to peak systole in a descending portion of the systolic waveform.

Another implementation includes controlling inflation of the inflatable devices in sequence from the distal inflatable device to the proximal inflatable device. A controller controls inflation of the distal inflatable device ahead of closure of the aortic valve such that a retrograde flow pulse reaches the root of the aorta when the aorta closes. The proximal inflatable device inflates when the pulse generated by the distal inflatable device reaches the midpoint of the proximal inflatable device.

One variation of an external counterpulsation apparatus and method for treating a patient includes a controller in communication with the fluid distribution assembly and controlling inflation and deflation of the inflatable devices. The controller controls at least one of a plurality of inflation functions including: rate of pressure applied by the inflatable devices to the lower extremities of the patient; the magnitude of external pressure applied by the inflatable devices to the lower extremities of the patient; the duration of time that external pressure is applied by the inflatable devices to the lower extremities of the patient; and a duration of time to deflate the inflatable devices. The controller controls at least one of these inflation functions to produce an external pressure waveform minimizing end diastolic pressure.

Another external counterpulsation apparatus and method for treating a patient includes the controller in communication with a fluid distribution assembly and controlling inflation and deflation of the inflatable devices. The controller controls inflation of the inflatable devices by inflating the distal inflatable device to a pressure greater than the proximal inflatable device. The distal inflatable device is inflated to a pressure approximately ten (10) to twenty (20) millimeters Hg greater than the proximal inflatable device.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Exemplary embodiments of external counterpulsation apparatus useful in the methods of this invention are depicted in FIGS. 1–12.

In particular.

Figure 1:
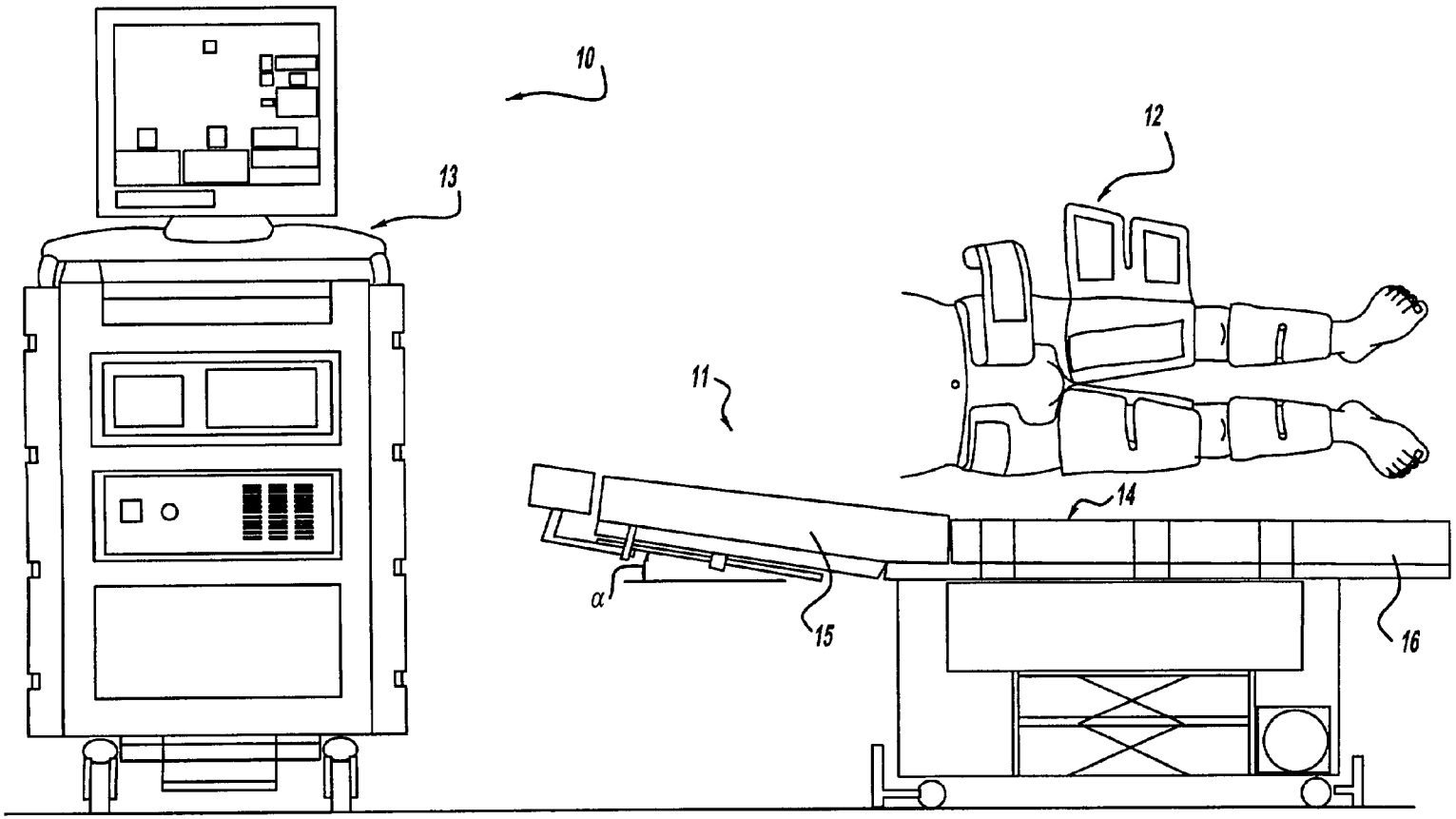
FIG. 1 is a diagrammatic view of an external counterpulsation apparatus.

It should be noted that the drawings of devices and counterpulsation pressure waveforms set forth herein are intended to exemplify the general characteristics of external counterpulsation embodiments among those useful in the methods of this invention, for the purpose of describing such embodiments herein. These drawings may not precisely reflect the characteristics of any given embodiment, and are not necessarily intended to define or limit specific embodiments within the scope of this invention.

DETAILED DESCRIPTION OF THE PREFERRED EMBODIMENTS

The present invention relates to an external counterpulsation apparatus and method for controlling an external counterpulsation apparatus. Such methods include the use of an external counterpulsation device, and may optionally use other devices and pharmaceutical treatments. Such devices and treatments useful herein must, accordingly, be therapeutically acceptable. As referred to herein, a "therapeutically acceptable" component is one that is suitable for use with humans and/or animals without undue adverse side effects (such as toxicity, irritation, and allergic response) commensurate with a reasonable benefit/risk ratio.

External Counterpulsation Method:

The methods of the present invention include administering external counterpulsation to a human or other animal subject. As referred to herein, "treatment" includes effecting a long-term physiological improvement in cardiac function, as well as symptomatic improvement, in a subject. Administering external counterpulsation (herein "ECP") to a subject includes applying external pressure to an extremity of the subject so as to create retrograde arterial blood flow and enhanced venous return from the extremity to the heart of the subject during diastole (i.e., the period of relaxation of the left ventricle of the heart). Preferably, the extremity comprises one or more of the legs of the subject, in a human subject preferably including both legs and both arms. In another embodiment, extremity in a human subject comprises both legs, more preferably including the calves, thighs, and upper thighs, and buttocks of the subject. In a preferred embodiment, the external pressure is applied using a plurality of pressure devices applied to the extremities of the subject, and inflated and deflated in synchrony with the cardiac cycle of the subject so as to create a pulse of arterial blood that arrives at the heart essentially at the end of the ejection phase of the left ventricle and closure of the aortic valve. In a preferred embodiment, the administration of optimized ECP is performed using an optimized ECP apparatus, preferably as described herein. (As used herein, the words "preferred" and "preferably" refer to embodiments of the invention that afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the invention.)

Preferably, optimized ECP is administered on at least about fifty (50) percent of the days of the treatment period (i.e., on at least about forty (40) days of an eighty (80)-day treatment period), more preferably on at least about seventy (70) percent, more preferably at least about eighty-five (85) percent, of the days of the treatment period. Preferably, optimized ECP is administered at least four (4) days during every seven (7)-day period of the treatment period, such that there are no more than three (3) consecutive days in which optimized ECP is not administered. More preferably, optimized ECP is administered at least five (5) days, even more preferably at least six (6) days, during every seven (7)-day period during the treatment period. Preferably, optimized ECP is administered for from about thirty (30) minutes to about two hundred (200) minutes for each day during which treatment is administered, preferably from about sixty (60) minutes to about eighty (80) minutes per day of treatment. Preferably, the daily administration of optimized ECP is performed in one or more sessions, for from about twenty (20) to about ninety (90) minutes, preferably for from about forty-five (45) minutes to about sixty (60) minutes, more preferably for about sixty (60) minutes per session. As referred to herein, a "session" of optimized ECP comprises the repeated inflation and deflation of pressure devices in synchrony with the cardiac cycle of the subject in a substantially continuous manner. Preferably from one (1) to three (3), more preferably one (1), session is conducted during each day in which optimized ECP therapy is administered. A preferred method comprises from one (1) to three (3) sessions of optimized ECP therapy during each day of at least four (4) days of every seven (7)-day period during a treatment period of from about twenty (20) to about sixty (60) days. Another preferred method comprises the steps of:

(a) administering to said subject an optimized ECP therapy session lasting from about twenty (20) minutes to about ninety (90) minutes and repeating said therapy session for from one (1) to three (3) times per day for at least about seventy (70) percent of the days during a treatment period of from about twenty (20) to about eighty (80) days; and (b) monitoring said subject to assess the safety and or efficacy of said therapy session.

Optimized ECP accomplishes many hemodynamic effects including: lowering end diastolic pressure to initiate left ventricle ejection earlier, reducing energy spent in isovolumetric contraction and giving more energy to ejection to increase cardiac output; and increasing velocity of circulating the blood, both antegrade and retrograde, to increase sheer stress on endothelial cells. These hemodynamic effects are characterized as follows:

(a) increased venous return;
(b) increased diastolic filling;
(c) increased stroke volume;
(d) generating retrograde arterial pressure or flow pulse
(e) increasing diastolic pressure
(f) increasing coronary blood flow
(g) enhancing coronary collateral circulation development
(h) increasing whole body mean perfusion pressure
(i) reducing peripheral resistance
(j) creating "sucking effect" by releasing external pressure on vascular space previously compressed
(k) creating systolic unloading; and
(l) increasing cardiac output without increasing systolic pressure.

Two effects of counterpulsation, namely, increased cardiac output and systolic unloading, are in conflict with each other. The more improvement in cardiac output optimized ECP can achieve, the harder it is to reduce systolic pressure. More particularly, due to increased venous return, increased cardiac output increases systolic pressure because of the pressure-volume relationship in the aorta. Under normal conditions, a stroke volume (i.e., the volume of blood that is pumped out during each heartbeat) of fifty (50) milliliters of blood would raise the aortic pressure from a diastolic pressure of eighty (80) millimeters Hg to a systolic pressure of one hundred twenty (120) millimeters Hg. If the stroke volume increased forty percent to seventy (70) milliliters, the systolic pressure should be one hundred thirty-six (136) millimeters Hg, making systolic unloading difficult to achieve.

This conflict can be partially resolved as long as the peripheral vascular space that has been compressed before is large enough to produce the suction effect to receive the increase cardiac output. Thus, optimized ECP compresses as much peripheral vascular tissue as possible. There is a limit, however, to the peripheral artery space, and it is usually smaller than the venous space. Therefore, as ECP performance is optimized, systolic pressure may not be significantly reduced.

But the reduction in systolic pressure during optimized ECP may also be understated as a result of the way in which it is measured. This can be further explained by examining a normal heartbeat wherein the heart pumps out blood during systole causing blood pressure to increase from diastolic pressure (usually eighty (80) millimeters Hg) to peak systolic pressure (usually one hundred twenty (120) millimeters Hg). For this example, a stroke volume of fifty (50) milliliters produces a rise of forty (40) millimeters Hg in the aorta (to about one hundred twenty (120) millimeters Hg from eighty (80) millimeters Hg). Assuming a linear relationship between volume and pressure, the larger the volume of blood being pumped out of the heart, the greater the rise in systolic pressure. For this same normal heartbeat during optimized ECP, because venous return increases, the stroke volume will generally increase about thirty (30) percent to fifty (50) percent. If there is an increase of fifty (50) percent, then a non-optimized ECP stroke volume of fifty (50) millimeters becomes an optimized ECP stroke volume of about seventy-five (75) millimeters. This appears as a rise of sixty (60) millimeters Hg from normal diastolic pressure, giving a systolic pressure of about one hundred forty (140) millimeters Hg.

But during optimized ECP treatment, a slight reduction of systolic pressure to one hundred ten (110) millimeters Hg is typical, at least implying that the systolic pressure is actually reduced from one hundred forty (140) millimeters Hg to one hundred ten (110) millimeters Hg, a significant reduction. However, because the observed systolic pressure without optimized ECP is one hundred twenty (120) millimeters Hg, a systolic pressure of one hundred ten (110) millimeters Hg during optimized ECP—a reduction of only ten (10) millimeters Hg instead of thirty (30) millimeters Hg—might lead to an erroneously conclusion that systolic reduction is not significant during optimized ECP.

Even though it is advantageous to reduce systolic pressure to give the heart a rest, increasing cardiac output, blood flow velocity, circulation and endothelial cells shear stress also improve cardiac function, i.e., by increasing release of nitric oxide ($NO_2$) and reducing vascular resistance. As mentioned above, increasing cardiac output and systolic unloading may be in conflict when using the same inflation/deflation times and applied pressure. In this circumstance, shifting the emphasis from systolic unloading to maximal reduction of end diastolic pressure augments cardiac output by redistributing the increased energy supply from diastolic augmentation so that less energy is spent in left ventricular isovolumetric contraction, and more energy is spent ejecting the larger volume of blood returned to the heart due to increased venous return. In this way optimized ECP differs from other counterpulsation techniques such as intraaortic balloon pumping (IABP) because such other techniques do not increase venous return; therefore, there is no need to reserve the extra energy to pump out the extra volume returned to the heart.

Thus, systolic unloading is not necessarily an objective of optimized ECP, unlike maximizing diastolic augmentation and minimizing end diastolic pressure. Optimized ECP, therefore, seeks to minimize end diastolic pressure (governed by deflation timing, i.e., determining the appropriate time in the cardiac cycle to remove applied pressure), and the maximization of diastolic augmentation (governed by inflation timing, i.e., determining how to cause the retrograde pulse to arrive at the root when aortic valve closes and how long does it hold in relationship to deflation time). The use of sequential application of pressure to the patient's limbs further helps achieve these objectives.

Features employed to increase cardiac output, blood flow velocity, circulation and shear stress on the endothelial cells, and thereby improve cardiac output include: Timing inflation and deflation to minimize end diastolic pressure and maximize diastolic augmentation; controlling the magnitude of externally applied pressure to maximize emptying of vasculature under external pressure; controlling the rate of application of external compression; controlling the rate of deflation of external compression; controlling the volume of peripheral tissue under compression; sequentially timing inflation from distal to proximal portions of body to milk blood back to the heart; controlling the gradient of applied pressure from distal to proximal portions of body to reduce the leakage of blood back to distal portion; and applying pressure uniformly in each section (cuff) along the length of the body.

Optimized ECP Apparatus:

Preferably administration of optimized ECP is performed using an optimized ECP apparatus (herein, "optimized ECP apparatus"), including (a) one or more pressure devices that are applied to an extremity of the subject; (b) a device for inflating and deflating the pressure devices; and (c) a controller that initiates inflation and deflation of the pressure devices in synchrony with the cardiac cycle of the subject. An exemplary optimized ECP apparatus (10) is depicted in FIG. 1, including three (3) basic component assemblies, namely: a treatment table assembly (11); a pressure device (12); and control console assembly (13), preferably including a device for inflating and deflating the pressure devices and a controller that initiates inflation and deflation of the pressure devices. Alternative embodiments comprise one (1) or two (2) component assemblies.

The optimized ECP apparatus preferably comprises pressure devices that are applied to the legs or other limbs of the subject, preferably to the calves, thighs and buttocks of the subject. Such pressure devices apply pressure to the limb using, in a preferred embodiment, a bladder that is inflated with a fluid, preferably air. Preferably the pressure device comprises a bladder and a fastener that holds the bladder against the limb, so that when the bladder is inflated pressure is applied to the limb. In a preferred embodiment, the fastener comprises a cuff body that holds the bladder against the limb, preferably a cuff surrounding a bladder. Preferably, each bladder applies from about one hundred forty (140) to about three hundred twenty (320) millimeters Hg of pressure to the limb. The fastener is made, for example, from materials including vinyl, leather, cloth, canvas, and rigid or semi-rigid materials such as plastic or metal. Different sizes of bladders and fasteners may be provided to meet the requirements of different body shapes. Preferably space between the fastener and the bladder and between the bladder and the limb is minimized. A preferred pressure device comprises a rectangular bladder. Also, preferably, the upper and lower thigh pressure devices are a one-piece design to prevent the lower thigh pressure device from sliding during treatment.

Figure 2:
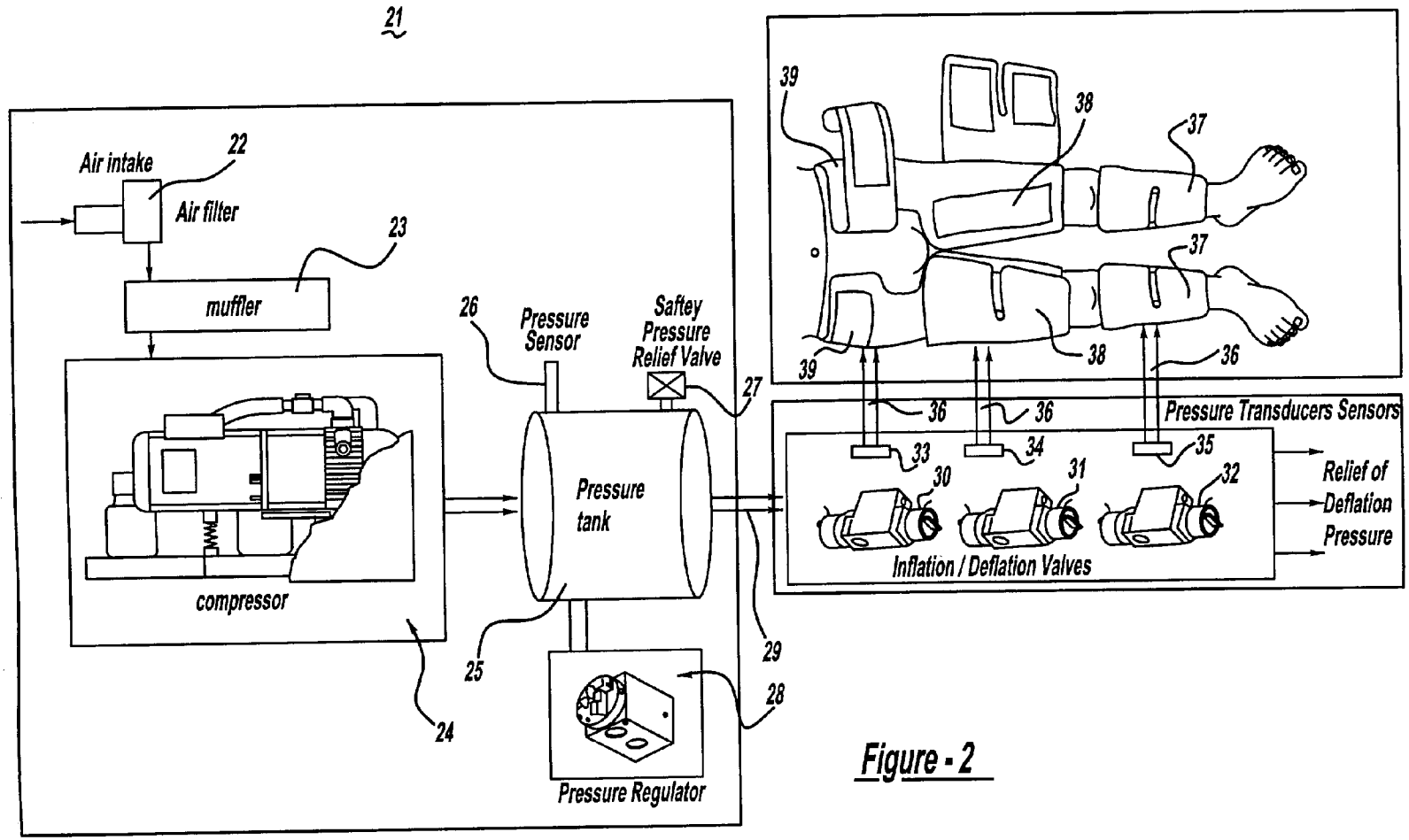
FIG. 2 is a diagrammatic representation of the fluid (air) handling system of an external counterpulsation apparatus.

The optimized ECP apparatus also preferably comprises a device for inflating and deflating the pressure devices using a fluid, such as air. In a preferred embodiment, where the pressure devices are inflated with air, the inflating and deflating device comprises a compressor and an air distribution mechanism that operates to distribute the air from the compressor to the pressure devices. FIG. 2 depicts a preferred embodiment of the compressed fluid (preferably compressed air) flow arrangement for the optimized ECP apparatus (21). The apparatus generally includes an air intake/filter assembly (22), one or more mufflers (23), which can be located before or after a compressor assembly (24), a pressure tank (25), a pressure sensor/transducer assembly (26), a pressure safety relief valve (27), and a pressure regulator (28). A temperature sensor may also be included (not shown). In one embodiment, the components are housed within a cabinet or housing of the control console assembly (13). Alternatively, these components may be housed separately, such as in another housing or incorporated into the treatment table assembly (11).

A hose connection assembly (29) is used for quick connecting and disconnecting the above-described components with those mounted on, or otherwise associated with, an assembly including valves that individually control inflation and deflation of the pressure devices. In a preferred embodiment, the valve assembly is part of a treatment table assembly (11). Such a treatment table assembly components include a valve manifold, a number of sequentially operable inflation/deflation valves (30), (31) and (32). Each valve (30), (31), (32) may have an associated pressure transducer/sensor (33), (34), and (35), respectively. A connect/disconnect assembly (36) is provided for quick and easy connection and disconnection of the inflation/deflation valves with associated pressure devices, e.g., the calf pressure devices (37), lower thigh pressure devices (38), and upper thigh pressure devices (39), respectively. In this embodiment, the inflation/deflation valves (30), (31), and (32) are a rotary actuable butterfly-type valve, which can be actuated pneumatically or electrically. In another embodiment, the valve assembly is part of the central console, and the patient may lie on any suitable table or bed.

In one embodiment, the subject may lie on an ordinary bed for treatment. In an another preferred embodiment, the optimized ECP apparatus comprises a bed as part of the treatment table assembly. As depicted in FIG. 1, the treatment table assembly (11) preferably comprises a support surface (14) having an articulating portion (15) and a horizontal portion (16). The articulating portion (15) of support surface (14) is hingedly or otherwise pivotally interconnected to the horizontal portion (16) for adjustment, either manually or by way of a power drive, to a plurality of angulated positions relative to the horizontal portion (16). The angulated position of the articulating portion (15) relative to the main horizontal portion is preferably limited to an angle a that is from about 15° to about 30° above the horizontal. Preferably, the elevation assembly comprises a motor to raise and lower the bed. Also, preferably, the treatment table assembly is configured for mobility (e.g., having wheels) from one location to another.

Figure 3:
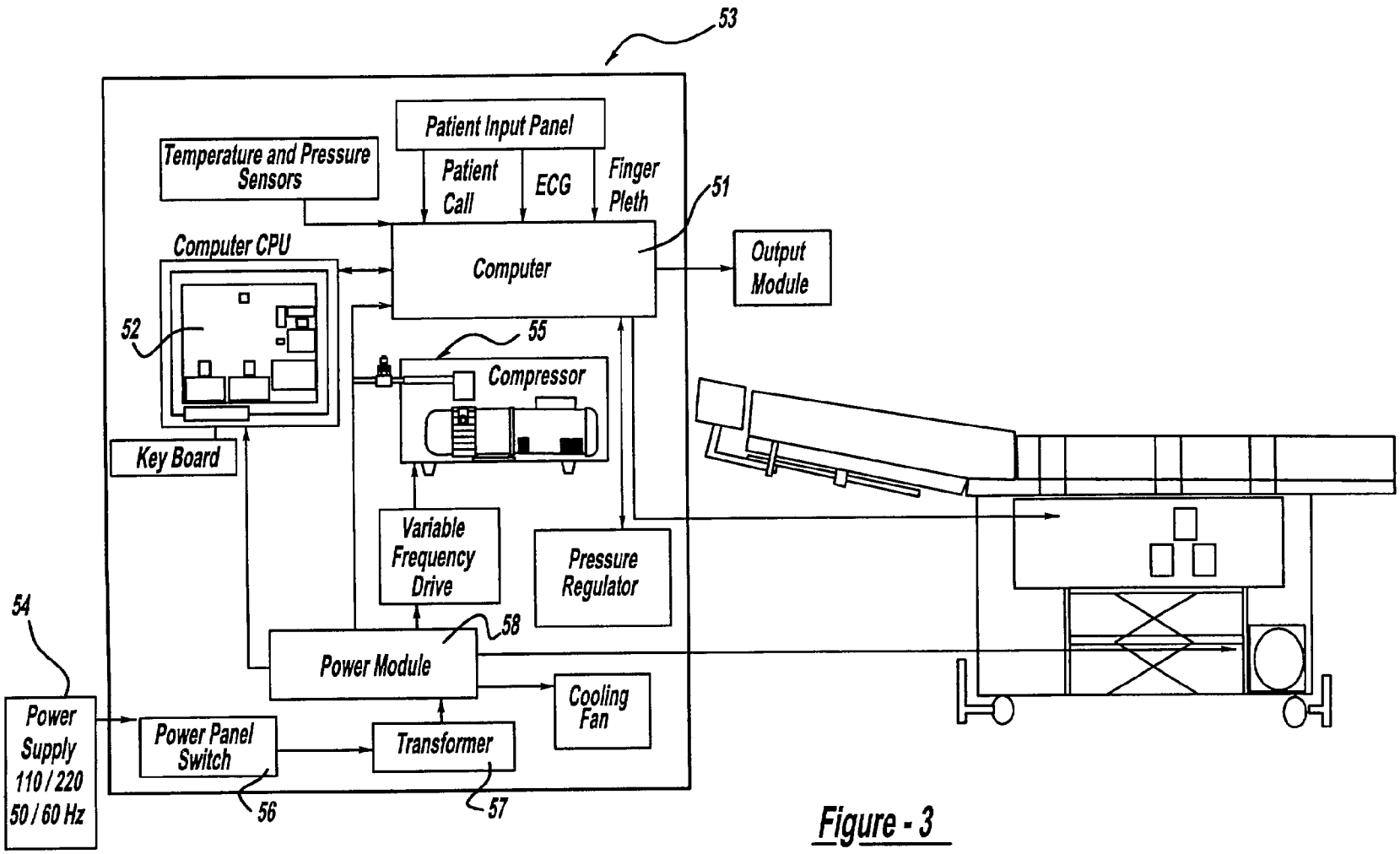
FIG. 3 is a diagram for a control mechanism for an external counterpulsation apparatus.

The optimized ECP apparatus also preferably comprises a controller that initiates inflation and deflation of the pressure devices in synchrony with the cardiac cycle of the subject. In a preferred embodiment, the controller is part of a control console assembly. As depicted in FIG. 3, one control console assembly embodiment generally includes a computer (51), a user interface device (52), such as a computer monitor or touch screen, and a cabinet or housing (53), in which various system components are located and housed. The control console assembly preferably includes a power supply (54) that feeds power to the computer (51) and the compressor assembly (55) by way of a power switch panel (56), transformer (57), and power module (58), which includes a power converter and ramp-up assembly. Preferably, the control console assembly (53) is mounted on wheels for mobility from one location to another upon wheels.

The user interface (52) is preferably a touch screen monitor for easy monitoring of patient treatment status, treatment parameters, and other relevant data, and provides the capability for adjustment to control operation. In one embodiment, the computer (51) monitors and records information associated with the treatment of the patient. Alternatively, another computer or remote computing system can be used to monitor and record information associated with the treatment of one or more patients. The user interface also provides switches or computer links to switches for adjusting the timing of the inflation/deflation cycle, allowing the operator to adjust the setting of the time for the start of sequential inflation as it is measured relative to the R peak of the treated subject's ECG signal, as further described below.

The apparatus may be configured so as to be self contained, i.e., with all components proximately located. Alternatively, one or more components may not be proximate, but connected to the other components through electrical (wired or wireless) or other appropriate mechanical connections. In some embodiments, the apparatus may have duplicate components (e.g., the user interface), with one component proximate to the device, and another at a remote location. In one embodiment, a user interface may be located remotely from the remainder of the device, such as in another room in the treatment facility. The computer may be located remotely from the remainder of the equipment, such as in the same facility (e.g., through remote cabelling or as part of a local area network), or in another facility (e.g., connected through an appropriate telecommunications device). The apparatus may comprise a computer proximate to the rest of the apparatus, but is connected to another computer for remote acquisition, storage, or maintaining of data. A remote user interface may be used to control two or more devices.

In a preferred embodiment, the user interface (52) displays treatment information, including an electrocardiograph (ECG) signal from the subject being treated. As will be apparent to one skilled in the art, the R wave portion of the ECG signal is typically used to monitor the cardiac cycle of the patient. Preferably, the blood flow and/or blood pressure of the patient is also displayed, e.g., to facilitate monitoring of the cardiac cycle of the subject as well as the effect of the counterpulsation waves being applied to the optimized ECP apparatus. In one embodiment, the signal is a photo-plethysmograph waveform signal as received from a finger plethysmograph probe.

The controller initiates inflation and deflation of the pressure devices in synchrony with the subject's cardiac cycle. Inflation and deflation is effected so as to create a retrograde pulse of arterial blood that arrives at the heart at approximately the end of the ejection phase of the left ventricle at the time of aortic valve closure. The time of aortic valve closure may be determined through direct or indirect measures. In a preferred embodiment, the time of aortic valve closure is determined indirectly using finger plethysmography. The synchronization of inflation and deflation of the pressure devices is exemplified in FIG. 4. As shown, the controller generates signals (61) for opening and closing valves that release air from the pressure tank to the pressure devices. These signals are synchronized with the treated subject's ECG (62), with the R-wave (63) as a trigger point. The pressure devices are inflated sequentially as shown by pressure waveforms (64).

The safety and effectiveness of the optimized ECP therapy depends on the precise timing of the inflation/deflation cycle in relation to the cardiac cycle of the patient. For example, a hardened arterial wall (i.e., with significant calcium deposits) will transmit the external pressure pulse up the aorta faster than an elastic artery. Therefore, the inflation valves should be opened later for a calcified artery than for a normally elastic artery. Accordingly, determination of inflation and deflation of the pressure devices is preferably adjusted for every individual subject to be treated.

In a preferred embodiment, there are several factors that are taken into account to determine the appropriate deflation time of the pressure devices. They include release of all external pressure before the next systole to produce maximal systolic unloading (maximum reduction of systolic pressure), and maintenance of inflation as long as possible to fully utilize the whole period of diastole so as to produce the longest possible diastolic augmentation (maximum increase of diastolic pressure due to externally applied pressure). Therefore, one measurement of effective counterpulsation is the ability to minimize systolic pressure, and at the same time maximize the ratio of the area under the diastolic waveform to that of the area under the systolic waveform.

Also, preferably, inflation and deflation timing is adjusted to minimize end diastolic pressure. Preferably, timing is adjusted so as to maximize systolic unloading and diastolic augmentation.

Further, there are two basic safety criteria: (1) the inflation valves must not be opened so that the pressure pulse wave reaches the root of the aorta during systole, forcing the aortic valve to close prematurely, thereby creating systolic loading; and (2) the deflation valves are opened to the atmosphere before the next R wave to allow enough time for the air pressure in the pressure devices to decay so there is no significant residual pressure causing a tourniquet effect. Preferably, the air pressure decays to from about zero (0) to about fifty (50) millimeters Hg, more preferably from about zero (0) to about twenty (20) millimeters Hg. Finally, the inflation/deflation valves are preferably not operational when the heart rate is higher than one hundred twenty (120) beats per minute or lower than thirty (30) beats per minute.

In a preferred embodiment, the inflation/deflation timing control logic of the optimized ECP apparatus is divided into two main parts: (1) the initiation stage upon power up of the apparatus, during which the inflation/deflation times are set up automatically; and (2) the operation stage during which the inflation and deflation time can be adjusted manually. In a preferred embodiment, the timing is controlled by a microprocessor.

In a preferred embodiment (as depicted in FIG. 2), there are three (3) inflation/deflation valves (30), (31), and (32). Alternatively, there may be a separate inflation valve and a separate deflation valve for each pressure device. One inflation/deflation valve is for the calf pressure devices, one for the lower thigh pressure devices, and one for the upper thigh pressure devices. The inflation valves are normally closed, and selectively open to allow inflation when energized. Upon receipt of a signal from the inflation/deflation timing control, electrical power to the inflation valves will be switched on for a period of from about seventy (70) to about one hundred fifty (150) milliseconds, preferably from about one hundred (100) to one hundred twenty (120) milliseconds and will open them to the fluid reservoir 25. Upon receipt of the deflation valve signal, power to the deflation valves will be switched off for a period of from about one hundred (100) to about three hundred (300) milliseconds, preferably from about one hundred (100) to one hundred fifty (150) milliseconds, and will open the valves to the atmosphere, deflating the pressure devices. The deflation valves are preferably normally open, and closed when energized to that the pressure devices also automatically deflate upon loss of power.

Figure 5:
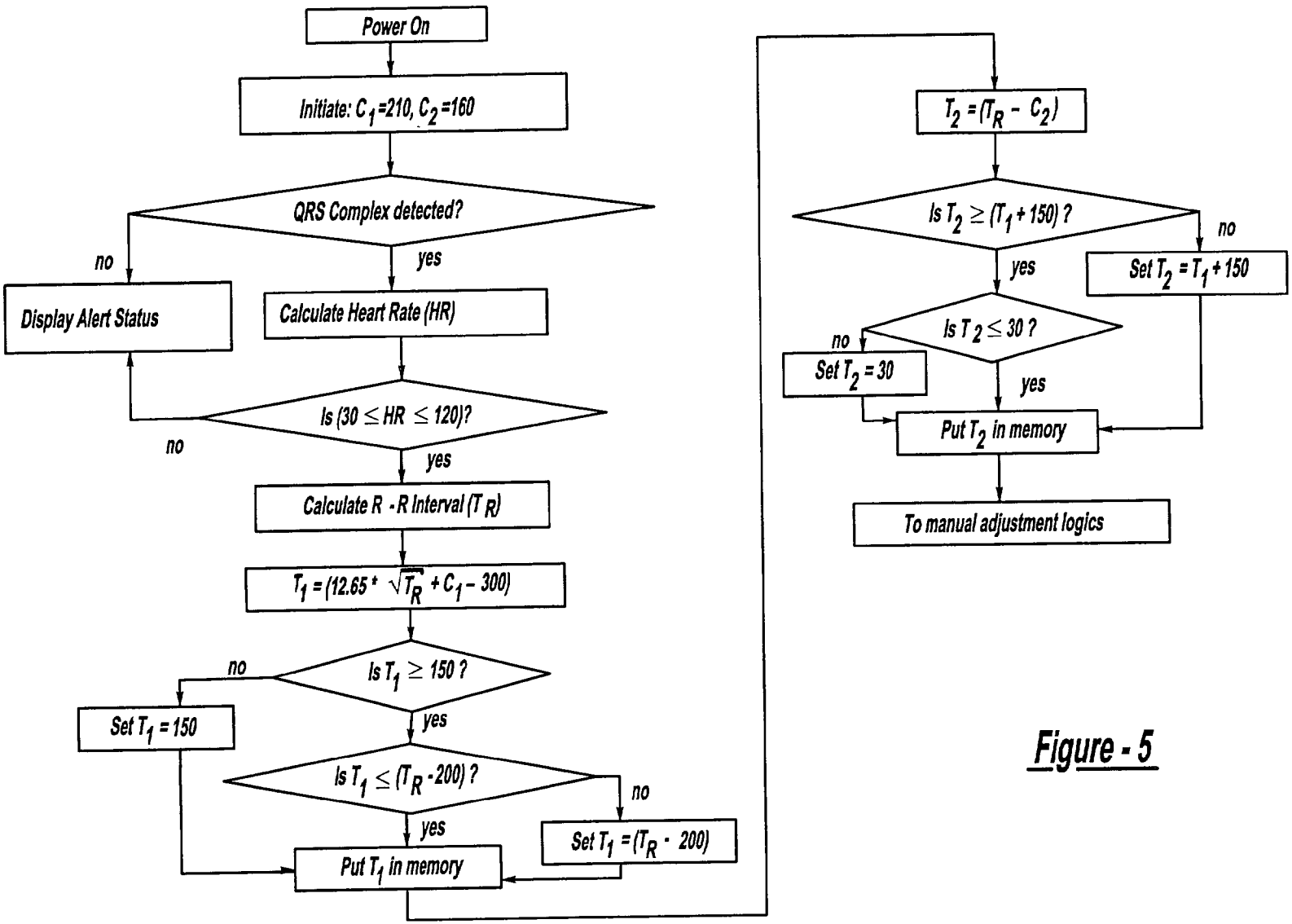
FIG. 5 diagrammatically illustrates initiation timing logic for inflation/deflation.

During the initiation stage when power is turned on, the computer will start a series of initiation procedures. An exemplary flow chart for these procedures is shown in FIG. 5. The deflation valves remain open to atmosphere. Each deflation valve will remain open for from about one hundred (100) to about three hundred (300) milliseconds, and preferably for about one hundred twenty (120) milliseconds, or long enough to relieve substantially all the air pressure from the leg and thigh pressure devices. The computer will then look for the input of the ECG and determine the presence of the QRS complex. If the QRS complex is not detected, the inflation/deflation valves will not be activated and the optimized ECP will not start. The inflation valves will remain closed, and no compressed fluid will enter the pressure devices from the tank.

Figure 6:
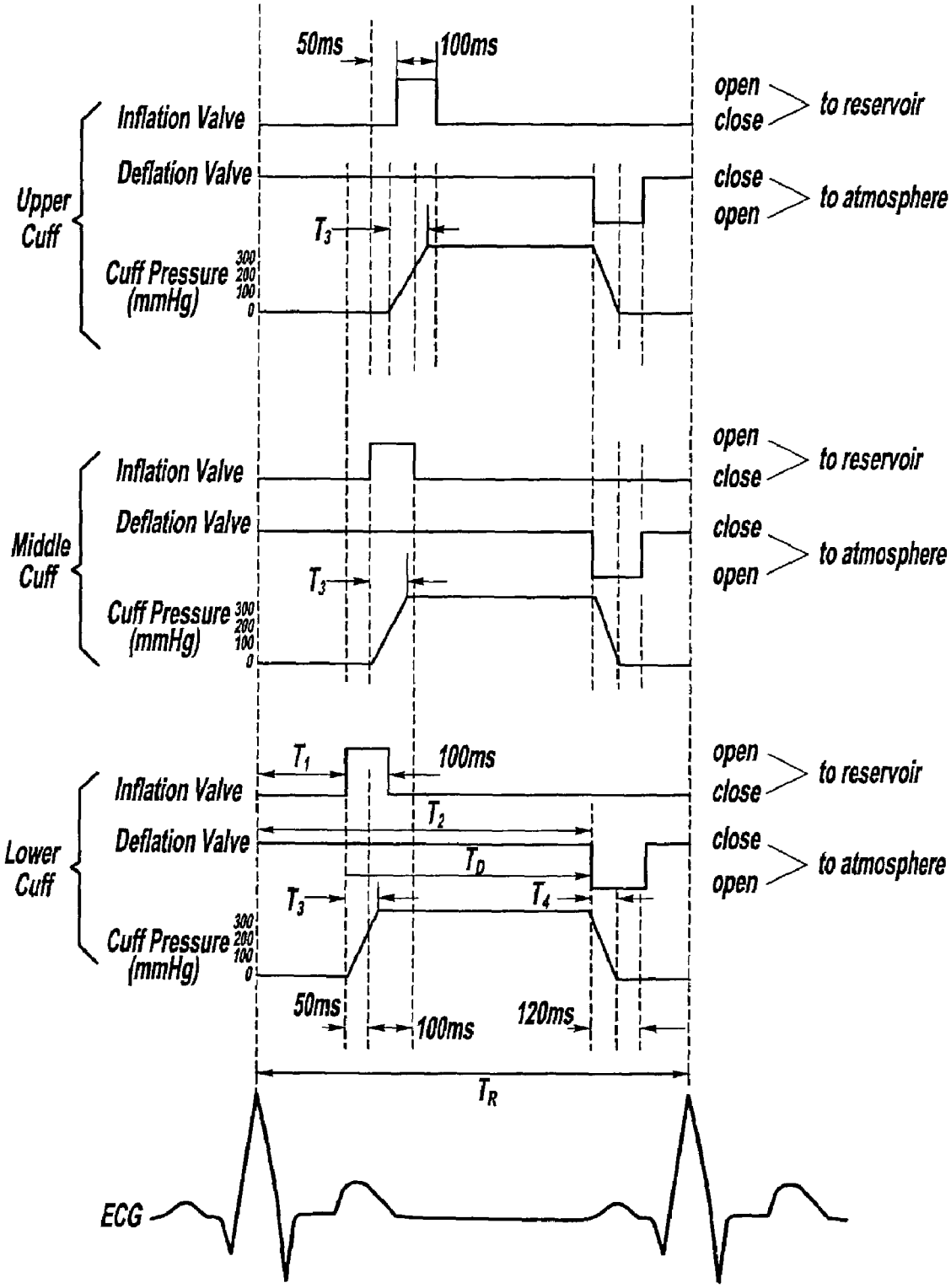
FIG. 6 is a graphic representation of the interrelationships among exemplary electrocardiogram, inflation/deflation valve timing, and cuff pressure waveforms.

The inflation/deflation valve timing logic controls the timing of external pressure applied to the lower legs and thighs of the patient. A diagram of the timing relationship between inflation/deflation valves and ECG R wave is shown in FIG. 6, for an embodiment having the three pairs of pressure devices. The key variables for operation of the inflation and deflation valves are the inflation time ($T_1$) and deflation time ($T_2$). Definitions of $T_1$ and $T_2$ and other variables shown diagrammatically in the example of FIG. 6 are as follows.

$T_R$ (R-R interval): average R-R interval in milliseconds.

$T_1$ (inflation time): interval from R wave to the opening of lower leg inflation valve in milliseconds. Note that the inflation valve for the lower thigh pressure devices preferably opens from about twenty (20) to about eighty (80) milliseconds, more preferably about fifty (50) milliseconds, after $T_1$. The inflation valve for the upper thigh pressure devices is preferably open for another twenty (20) to eighty (80), preferably fifty (50), milliseconds after the opening of the valve for lower thigh pressure devices. In addition, inflation valves are preferably normally closed. Preferably, they will be opened for a duration of one hundred (100) milliseconds or more when energized.

$T_D$ (duration time): interval between the opening of the lower leg inflation valve and the opening of the deflation valves for the pressure devices, in milliseconds.

$T_2$ (deflation time): interval from R wave to the opening of the deflation valves, in milliseconds. Preferably, the deflation valves for the inflatable devices and are normally open to the atmosphere, but are selectively closed when energized. This opening time is preferably at least about forty (40) milliseconds longer than the pressure decay time $T_4$.

$T_3$ (pressure rise time): interval between the time when the air pressure in the lower leg or thigh pressure devices is at its minimum (e.g., from about zero (0) to about fifty (50) millimeters Hg) and the time when it reaches its peak pressure. This value is preferably from about fifty (50) to about one hundred (100) milliseconds.

$T_4$ (pressure decay time): interval for the air pressure in the pressure devices to drop to its minimum pressure (e.g., from about zero (0) to about fifty (50) millimeters Hg) when the deflation valves are opened to the atmosphere. The value of $T_4$ preferably has an average value of from about sixty (60) to about one hundred twenty (120) milliseconds.

Figure 4:
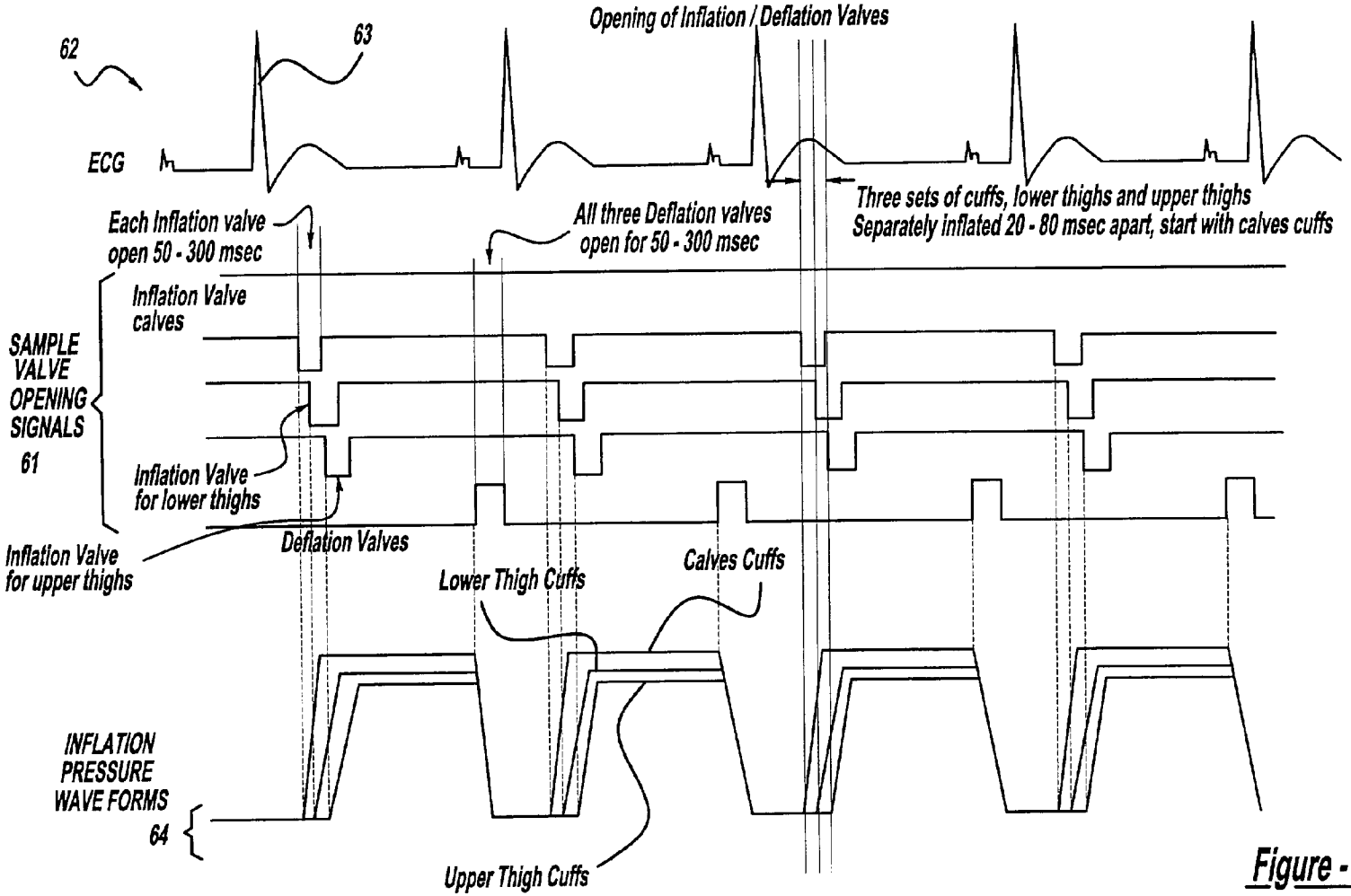
FIG. 4 is a graphic representation of the relationship between a subject's electrocardiogram, the sequential valve opening signals and the pressure device inflation pressure waveforms during operation of an external counterpulsation apparatus.

In calculating the intervals for inflation and deflation, the mechanical properties of the apparatus and the physiologic properties of the subject must be considered. In this regard, in one embodiment, it takes about twenty (20) milliseconds for the valves to fully open, about another thirty (30) milliseconds for the air pressure to arrive at the pressure devices, about another seventy (70) milliseconds to reach full inflation pressure, and about an additional one hundred fifty (150) to three hundred (300) milliseconds for the applied pressure wave to travel from the vasculature of the legs and thighs to the root of the aorta. If inflation was to actually start at the closure of the aortic valve, then these time delays would result in the pulse generated by the external pressure arriving at the root of the aorta long after the end of the systolic period. For example, for a heart rate of sixty (60) beats per minute, the systolic time is approximately four hundred (400) to five hundred (500) milliseconds per heartbeat. Therefore, for the applied pulse wave to arrive at the root of the aorta at the time the aortic valve closes, the inflation signal must start at least about one hundred fifty (150) to two hundred (200) milliseconds after the R wave. As shown in FIG. 4, the inflation time for the lower leg pressure device starts at approximately the peak of the T wave, not at the end of the T wave. The same timing considerations apply to the opening of the deflation valves. The opening of the deflation valve occurs about thirty (30) to one hundred sixty (160) milliseconds before the next R wave. Because ejection of blood from the heart does not begin until about fifty (50) milliseconds to one hundred (100) milliseconds after the R wave, and the ejected blood does not reach the extremity for another one hundred thirty (130) milliseconds to three hundred (300) milliseconds, there is ample time for the pressure to be released from the pressure devices and for the deflation valves to close before the next systolic augmentation cycle. Therefore, because the decay time $T_4$ is (at most) about one hundred twenty (120) milliseconds for the pressure devices device pressure to drop to its minimum value (e.g., zero (0) to fifty (50) millimeters Hg), there is little or no residual pressure at the beginning of the next systolic phase, giving the peripheral vascular bed ample time to refill during cardiac systole.

In initiating therapy, the computer will determine the average interval ($T_R$), after the detection of three to eight complete R-R intervals. The computer will update $T_R$ by taking the mean of the last $T_R$ and the new R-R interval. Values for the inflation time ($T_1$) and deflation time ($T_2$) are then determined as follows. The initial value assigned to $T_1$ is based on the following formula derived from that of Bazett, *Heart* 7:353 (1920), which approximates the normal Q-T interval of the ECG as the product of a constant (0.4) times the square root of the R-R interval measured in seconds.

$$T_1=(12.65*\sqrt{T_R}+C_1-300)ms$$

In this formula, the constant 12.65 is used instead of 0.4 when converting the unit of $T_R$ from seconds to milliseconds, and $C_1$ is a constant that is initially assigned a value equal to two hundred ten (210) milliseconds and may be adjusted as discussed below. The factor three hundred (300) milliseconds is equal to the approximate maximum time it takes for the applied external pressure wave to travel from the lower leg to the aortic valves.

After $T_1$ has been determined, it is compared to a value of one hundred fifty (150) milliseconds. If $T_1$ is less than one hundred fifty (150) milliseconds, it is then set to one hundred fifty (150) milliseconds. If $T_1$ is larger than one hundred fifty (150) milliseconds, then the calculated value will be used. This procedure guarantees that the inflation valves will not open in less than one hundred fifty (150) milliseconds after the R wave. Even when $T_1$ is set at one hundred fifty (150) milliseconds, the leading edge of the pressure wave will not arrive at the aortic root until approximately three hundred fifty (350) milliseconds after the R wave, taking into account the time required for the pulse to travel up from the peripheral vasculature to the root of the aorta.

Once the value of $T_1$ has finally been determined, it is used to calculate $T_2$ using the following formula:

$$T_2=(T_R-C_2)$$

where the constant $C_2$ is initially set at one hundred sixty (160) milliseconds. However, $C_2$ can be increased or decreased manually to achieve an optimal hemodynamic effect.

During the operation stage following the initiation stage, the values of $T_1$ and $T_2$ will be stored in memory in the controller, and used to control the inflation/deflation timing. However, the memory will be updated with every new heartbeat using the updated $T_R$ to calculate the new $T_1$ and $T_2$ and stored in memory replacing the old $T_1$ and $T_2$. In addition, the controller will interrogate periodically (e.g., every ten (10) milliseconds) a flag in a register to determine if any manual adjustment has been made.

Figure 7:
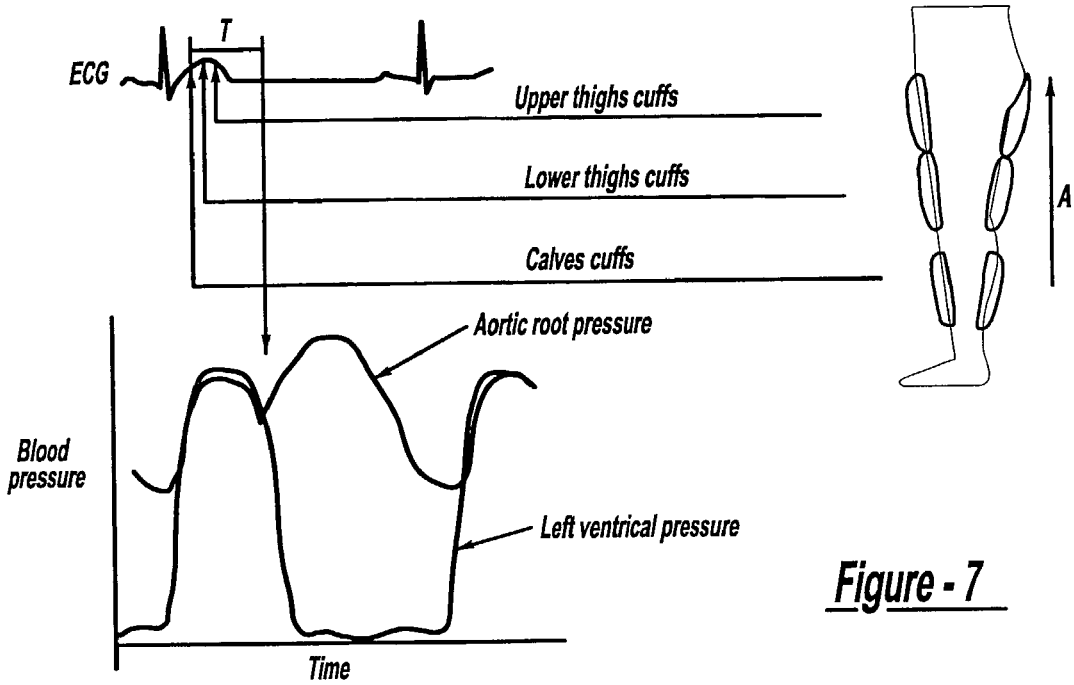
FIG. 7 is a graphic representation of the sequential inflation of exemplary pressure devices and the resulting blood pressure waveform.

In the inflation phase of optimized ECP, valve opening is controlled such that (i) the inflation valves furthest from the heart (distal) are opened at a time such that the pulse generated by the application of the external pressure in compressing the vascular bed travels up the arterial tree and reaches the root of the aorta when the aortic valve closes; and (ii) the second inflation valves are opened after the first valves according to a delay corresponding to when the peak of the pulse from the first pressure devices reaches the mid-point of the pressure devices controlled by the second valves (and similarly timed for the third and all other proximal pressure devices). Such a preferred embodiment for opening of the inflation valves in sequence is shown in FIG. 7. Sequential application of external pressure from the distal pressure devices to the proximal pressure devices "milks" the peripheral blood toward the heart. The sequential compression also eliminates the possibility of creating a tourniquet or "bottle neck" effect in the proximal segment of the vasculature, i.e., the occlusion of proximal arteries before distal arteries are compressed. Arrow A in FIG. 7 represents the retrograde blood flow created by the compression of pressure devices on arteries and micro-vessels. Note that the distal inflation valves open before the closure of the aorta valve as indicated by time period T because it takes approximately one hundred (100) to three hundred (300) milliseconds for the generated pulse to travel up the arterial tree.

In one embodiment, the delay in inflation between sets of pressure devices is approximated, using a fixed time interval (delay) between each set of pressure devices, e.g., ranging from approximately twenty (20) milliseconds to eighty (80) milliseconds and preferably about fifty (50) milliseconds. The delay in each of the successive sets of pressure devices is not fixed in another embodiment. In such an embodiment, timing is varied because the velocity of the pulse generated by the inflation of the distal pressure devices traveling up the peripheral vascular tree to the aorta and the heart (retrograde flow) changes according to the elasticity of the arterial walls of the patients and the rate of application of the external pressure. The delay required for optimized inflation of a distal pressure devices ahead of closure of the aortic valve and delay in opening subsequent inflation valves depends on the distance D of the distal pressure devices to the root of the aorta and elasticity E of the aortic wall. Elasticity E is calculated as dP/(dV/V). In this manner, velocity of the generated pulse traveling up the aorta is controlled. Accordingly, distal inflation valves open at a time such that the generated retrograde pressure or flow pulse will reach the root of the aorta when the aorta closes. The next set of inflation valves opens when the pulse generated by the distal compression reaches the midpoint of its respective pressure devices as determined by a pressure detector. Any subsequent inflation valves open in a similar manner, i.e., when generated distal pulses reach the midpoint of any such pressure devices. In one embodiment, the time delay for sequential inflation of the pressure devices is determined by first calculating the velocity of the retrograde pulse from the lower leg inflation device to the blood pressure detector (e.g., finger plethysmograph). This is calculated as the distance between the lower leg device and the pressure detector, divided by the time between inflation of the device and the detection of the retrograde pulse by the detector. The delay time between inflation of the lower leg device and the upper leg device can then be calculated by dividing the distance between the cuffs by the velocity. The delay between inflation of the upper leg device and the thigh inflation device can be similarly calculated.

In a preferred embodiment, the optimized ECP apparatus comprises manual inflation and deflation timing adjustment inputs, such as touch screen buttons or manual switches, as described above. Each depression of the inflation advance input triggers the controller to compare the value ($T_R$−$T_1$) to 200 milliseconds. If ($T_R$−$T_1$) is larger than two hundred (200) milliseconds, then $T_1$ will be lengthened by ten (10) milliseconds. This is done by adding ten (10) milliseconds to $C_1$ which has been initially set at approximately two hundred ten (210) milliseconds. The same logic is applied to limit the ability of advancing $T_1$ to approximately two hundred (200) milliseconds or less before the next R wave, in order to prevent the inflation valve of the calf pressure devices from opening so late that not enough time remains for the deflation valves to open before the next R wave; keeping in mind the facts that the inflation valve for the lower thigh pressure devices opens approximately fifty (50) milliseconds after $T_1$ and remains open for approximately another one hundred (100) milliseconds, followed by the opening of the upper thigh pressure devices fifty (50) milliseconds thereafter, leaving little, if any, time for the deflation valves to open before the next R wave. Because the logic used in controlling the manual adjustment of the deflation valves sets a limit for the deflation to open no later than approximately thirty (30) milliseconds before the next R wave, in the worst case scenario, the deflation valves will open to the atmosphere within approximately thirty (30) milliseconds after the inflation valve of the upper thigh pressure devices is closed.

The other manual inflation/deflation adjustment inputs work on the same principle; that is, with each depression of one of the manual inputs, the controller will check the conditions limiting the timing of the valves, and if the limits are not reached, then the timing for the inflation/deflation valves can be advanced or retreated by subtracting or adding ten (10) milliseconds to $C_1$ or $C_2$ of the above equation and the equation $T_2$=($T_R$−$C_2$) milliseconds.

Figure 8:
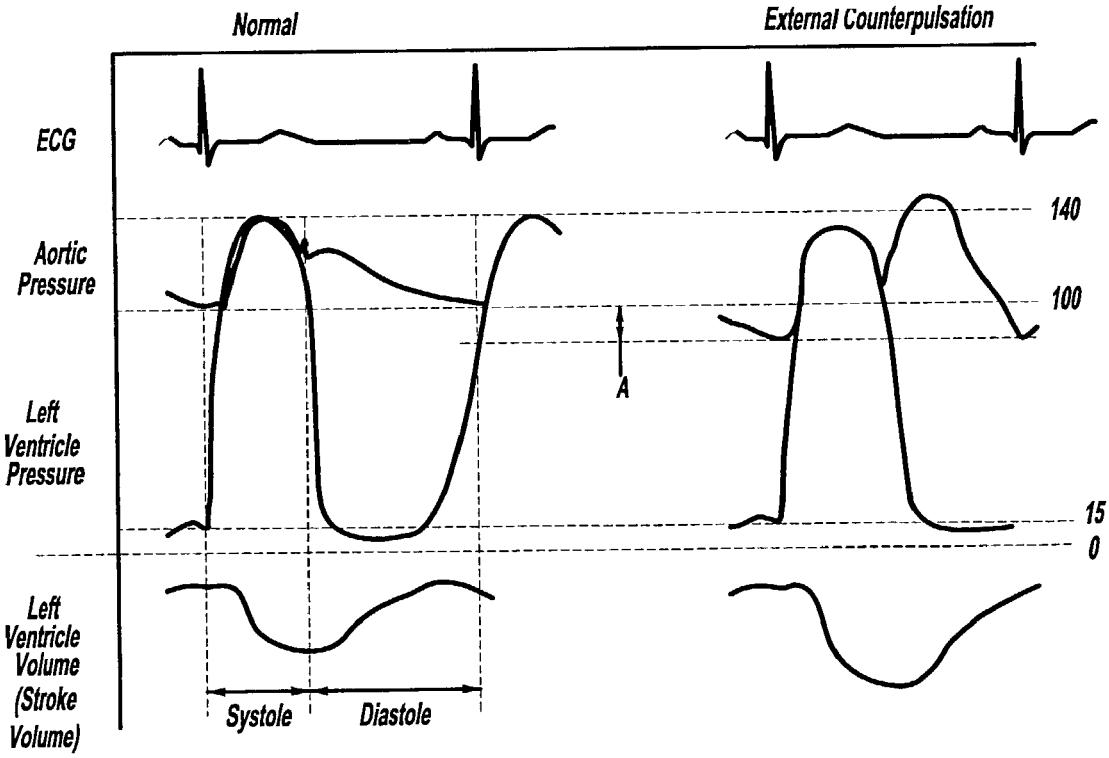
FIG. 8 is a graphic representation of the effect of counterpulsation on blood pressure and left ventricular stroke volume.

Manual adjustment of the optimized ECP therapy comprises adjustment of the inflation time (varying $C_1$) and deflation time ($C_2$), so as to optimize efficacy. Deflation time is preferably adjusted before inflation time. The objective of adjusting deflation time from the R-wave or other triggering signals is to release all external pressure to achieve maximal decrease in end diastolic (or presystolic) aortic blood pressure. As demonstrated in FIG. 8, by lowering end diastolic pressure, the aortic valve opens earlier at a lower left ventricular pressure, the magnitude of which is indicated at A. The left ventricle, thus, spends less energy in isovolumetric contraction and reserves more energy for contraction. This increases stroke volume and cardiac output.

Figure 9:
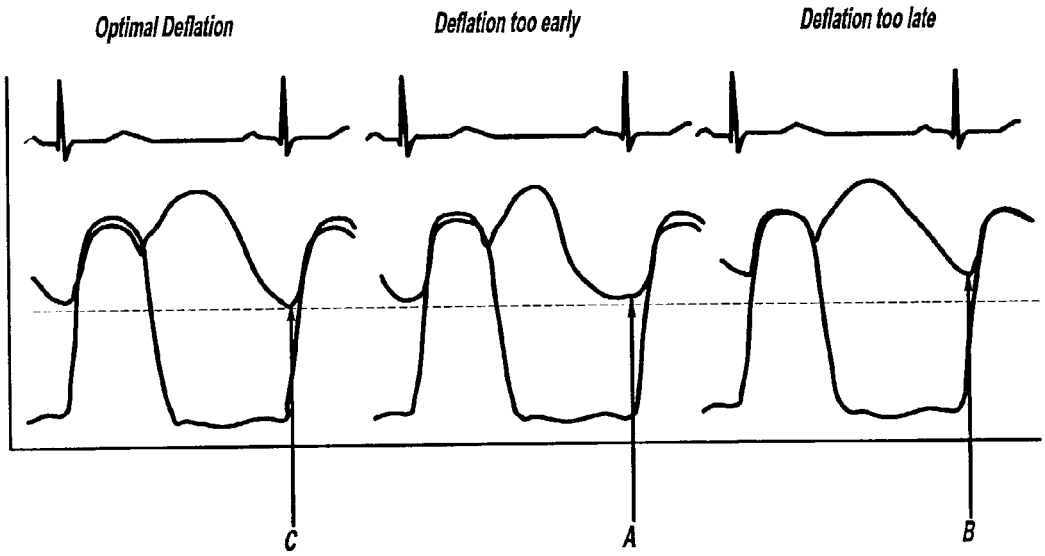
FIG. 9 is a graphic representation of deflation time optimization.

When deflation valves open too early, the end diastolic pressure is flat, as shown at A in the middle panel of FIG. 9. In this circumstance, blood from the upper portion of the body (i.e., head and neck) fills the peripheral vascular bed instead of the blood from the left ventricle, negating the "sucking effect" and reduction of systolic pressure by opening up the emptied vascular bed that has been previously compressed during diastole. In addition, opening the deflation valves too early reduces the area under the diastolic augmentation curve, thereby reducing coronary blood flow and energy supply to the myocardium. Further, if the deflation valves are opened too late, as shown at B in the right panel of FIG. 9, end diastolic pressure increases and the left ventricle spends more energy in isovolumetric contraction to generate more pressure before ejection begins. The left panel of FIG. 9 demonstrates timing the opening of the deflation valves to achieve maximum decrease in end diastolic (or presystolic) blood pressure, as indicated at C.

As mentioned before, the deflation time $T_2$ is initially set as ($T_R$−$C_2$), and $C_2$ is set as one hundred sixty (160) ms, that is the deflation time is set as one hundred sixty (160) ms before the next R-wave. After this initial set-up, the-operator is to adjust the deflation time manually to minimize the end diastole pressure. The first step is to adjust the deflation time earlier and observe the resulting changes in the patient pressure waveform to determine whether end diastolic pressure is lowered. If end diastolic pressure is lower, the deflation time is further adjusted to be earlier. If no change in end diastolic pressure is detected, then the deflation time is delayed to determine if there is any affect on end diastolic pressure. The procedures are repeated until the lowest end diastolic pressure is achieved with the latest possible deflation time. These steps ensure minimization of left ventricular isovolumetric contraction before ejection begins and maximization of diastolic augmentation by holding the diastolic compression as long as possible.

Figure 10:
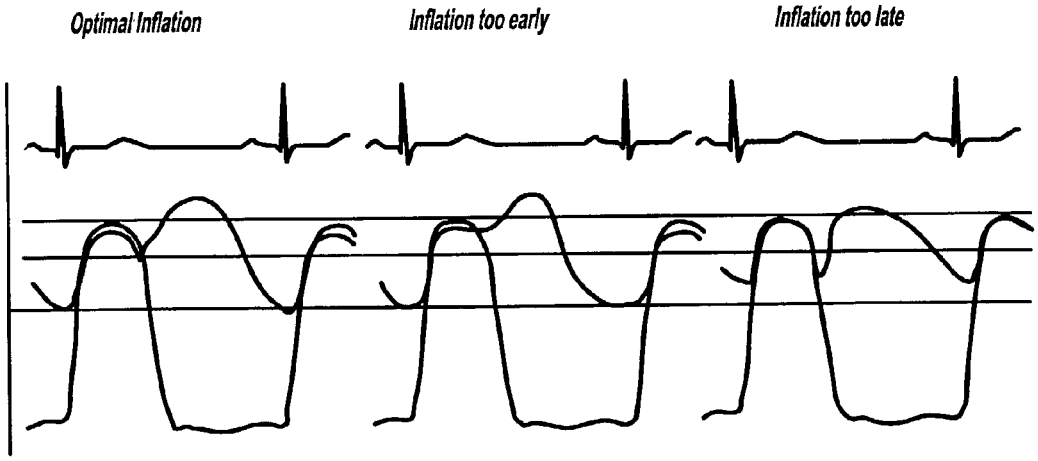
FIG. 10 is a graphic representation of inflation time optimization.

A diagrammatic representation of optimal inflation time is shown in the left panel of FIG. 10. If the inflation valves open too early (middle panel), retrograde pressure forces the aortic valves to close too early before the left ventricle finishes its ejection, thereby reducing cardiac output, and the applied external pressure becomes a load against which the heart must eject, thereby increasing cardiac workload. That is, the retrograde pressure is countered by left ventricle ejection when the myocardium is not in a relaxed state and resistance to coronary blood flow is still high. On the other hand, if the inflation valve opens too late (right panel), the myocardium has already begun to relax and blood pressure to the related coronary is not well-augmented to provide a high pressure to force open collateral channels and significantly supplement coronary blood flow. Late opening also reduces diastolic augmentation and fails to increase energy supply to the myocardium. Optimal valve opening, and thus inflation, causes a retrograde pressure or flow wave to reach the root of the aorta just at the point of time when the left ventricle finishes its contraction and the aortic valve closes.

Figure 11:
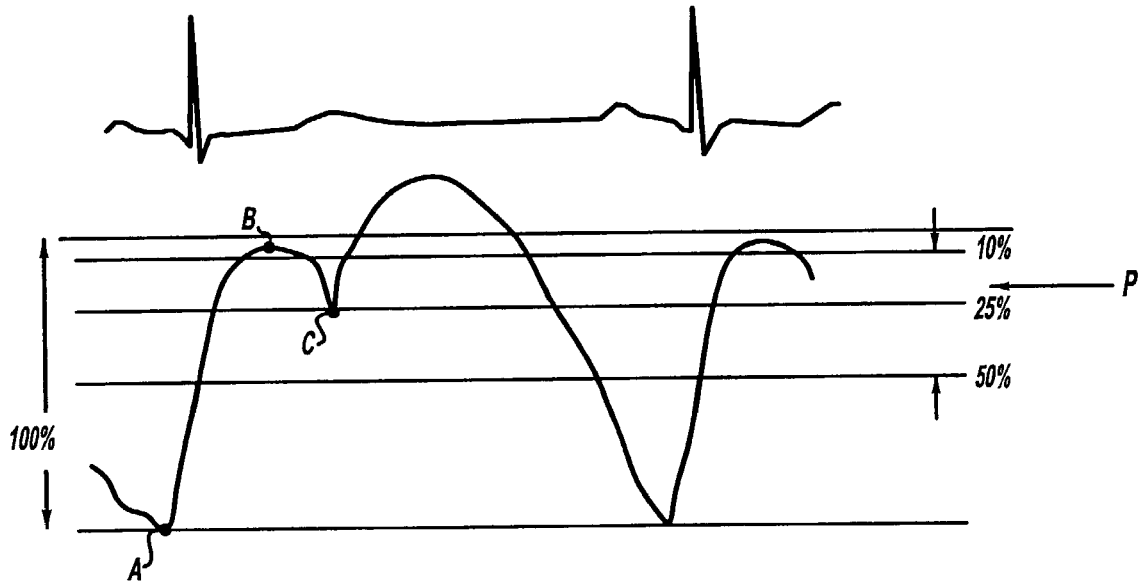
FIG. 11 is a graphic representation of optimizing inflation time by approximation when a dicrotic notch is not detected.

There are circumstances when the exact time at which aortic valve closes is difficult to detect, such as when noninvasive detection methods are used (e.g., finger plethysmograph) and a dicrotic notch does not appear on the resulting waveform. The dicrotic notch may not be visible because it is composed of a high-frequency wave that is attenuated much faster when transmitting through the vascular bed. In this case, as exemplified in FIG. 11, the inflation time is adjusted by approximation, such that the augmented diastolic waveform begins when the systolic pressure has dropped from about ten (10) percent to about fifty (50) percent of the distance from the end diastolic pressure (A) to the peak systolic pressure (B). Thus, the pressure drop from peak systolic pressure (B) to the beginning of diastolic augmentation pressure (C) is from about ten (10) percent to about fifty (50) percent, preferably about twenty-five (25) percent to about fifty (50) percent, of the difference in pressure between the end diastolic pressure (A) and peak systolic pressure (B); or B−C=×(B−A), where x is from about 0.1 to about 0.5, preferably 0.25 to 0.5. This approximation is derived from the observation that the counterpulsation pulse arrives at the root of the aorta, i.e., point C in FIG. 11, when the peak systolic pressure has dropped approximately ten (10) to fifty (50) percent, as shown at P.

Concerning the externally applied pressure waveform, optimal operation of the optimized ECP apparatus not only depends on proper inflation and deflation times, it also depends on the manner by which external pressure is applied, which is affected by the specific configuration of components of the apparatus. In particular, the time it takes for the applied pressure to rise to peak pressure (the rise time), the magnitude of the peak pressure, the length of time the pressure is applied (duration), and the speed with which the pressure is released (decay time), are considered.

Figure 12:
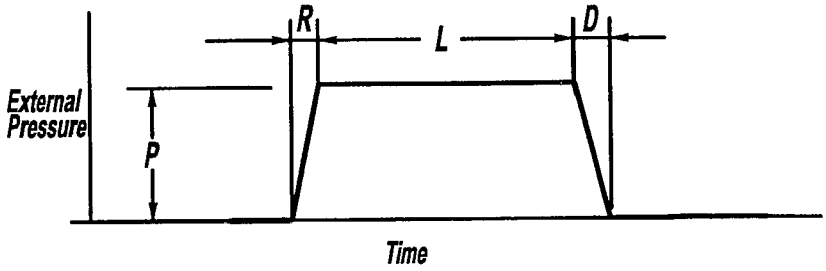
FIG. 12 is a graphic representation of an exemplary external pressure waveform.

Compression of the peripheral vascular bed produces a retrograde pulse that represents diastolic augmentation. The magnitude and velocity of propagation of the pressure wave up the aorta represents the potential and kinetic energy transmitted to the vasculature. The kinetic energy depends on the how fast the external pressure is applied, and the potential energy depends on the magnitude of the external pressure. Therefore, as shown in FIG. 12, the rate of rise time R, the magnitude of peak external pressure P, the time duration L of external pressure, and the time duration decay time D all contribute to the production of optimal pressure waveform.

The rise time R, or rate of applied pressure, depends on the rate of delivery of compressed fluid, which in turn depends on the magnitude of the compressed fluid in the reservoir (as high as possible but limited due to safety factors), the peak external pressure P to be applied to the body (about one hundred sixty (160) to three hundred (300) millimeters Hg for patient safety and comfort), the dimension of the inflation valves and hoses (as large as practical, i.e., one-half (½) to one (1) inch in diameter), the volume of each pressure device to be inflated (dead space should be reduced as much as possible). An acceptable rise time R, for example, is forty (40) to one hundred (100) milliseconds to inflate from zero (0) to three hundred twenty (320) millimeters Hg. The duration L of applied pressure is as long as possible, but is governed by inflation/deflation timing.

The peak external pressure P that can be applied to the body is the most important factor for effectiveness and safety considerations. In principle, one expects to apply a pressure slightly larger than the systolic pressure so as to collapse the conductive large arteries. However, that is typically not enough to compress the tissue surrounding the arteries, the microvessels that actually contain larger volume of blood. In addition, there is a loss of pressure from the skin layer through the muscle to the arteries. For example, some patients with very calcified arteries, or patients with very stiff peripheral muscle, require application of a greater pressure, but not so great as to induce trauma to the skin and muscle (e.g., by exceeding a tank pressure of about three hundred fifty (350) millimeters Hg.)

The decay time D is defined as the time taken for the pressure devices to deflate from peak external pressure P to atmospheric pressure. The faster the decay time D, the more efficient the deflation to lower end diastolic pressure. In addition, when the heart rate of the patient under treatment is high (one hundred (100) to one hundred twenty (120) bpm), the time for inflation and deflation is limited to a very short period, and it becomes necessary to shorten the decay time D to less than one hundred (100) to one hundred twenty (120) milliseconds. The implementation of fast decay is opening the deflation valves as large as possible, employing large diameter hoses, and, if necessary, using a vacuum source to suck the compressed air from the pressure devices, especially during the last portion of deflation when the pressure in the pressure devices is low. An acceptable rate of deflation, for example, is from about forty (40) to about one hundred twenty (120) milliseconds to deflate from about three hundred (300) to approximately atmospheric pressure (or as close thereto as practical).

Also, preferably, the volume of peripheral muscle under compression is maximized by using a pressure device size with length covering all peripheral volume below the iliac crest. Compressing above the iliac crest is not recommended because it is difficult to transmit any externally applied pressure to the vasculature in the abdominal cavity and often results in patient movement rendering the effort useless. Nonetheless, where such pressure can be efficiently transmitted and patient movement retarded, further maximization can be achieved. In addition to producing better diastolic augmentation, the maximal peripheral volume under compression would also produce larger venous return and more emptied vasculature when deflated to receive left ventricle ejected blood volume to achieve a lower systolic pressure as well as end diastolic pressure.

Concerning the pressure gradient between sets of pressure devices, further optimization is achieved by applying peak external pressure in the distal pressure devices that is higher than the proximal pressure devices. Thus, in addition to inflating successive sets of pressure devices sequentially from distal to proximal regions of the body with time delay in an effort to "milk" the peripheral blood back up the vascular tree, the peak applied external pressure in the distal pressure devices is higher than the proximal pressure devices, as shown also in FIG. 4. The pressure gradient between successive sets of pressure devices prevents blood from leaking distally and thereby diminishing the volume of blood that can be squeezed back up the aorta. Creating too great a pressure drop between pressure devices, however, causes too low an external pressure to be applied in the proximal portion of the body, i.e., the upper thighs and buttocks that have larger blood volume. Thus, a pressure drop of from about ten (10) to about thirty (30) millimeters Hg is desirable between successive set of pressure devices, depending the number of sets of pressure devices used. Further, a pressure of from about one hundred sixty (160) to about three hundred (300) millimeters Hg applied to the distal pressure devices and from about one hundred sixty (160) to about two hundred fifty (250) millimeters Hg applied to the proximal pressure devices is preferred. Preferably external pressure is applied in an even manner to each pressure device so that the muscle, and specifically the vasculature, under each pressure devices will have a uniform applied pressure.

Optimized ECP apparatus useful in the methods of this invention are disclosed in the following patent documents, all of which are incorporated by reference herein: U.S. Pat. No. 3,303,841, Dennis, issued Feb. 14, 1967; U.S. Pat. No. 3,403,673, MacLeod, issued Oct. 1, 1968; U.S. Pat. No. 3,654, 919, Birtwell, issued Apr. 11, 1972; U.S. Pat. No. 3,866,604, Curless et al., issued Feb. 18, 1975; U.S. Pat. No. 4,753,226, Zheng et al., issued Jun. 28, 1988; U.S. Pat. No. 5,554,103, Zheng et al., issued Sep. 10, 1996; U.S. Pat. No. 5,997,540, Zheng et al., issued Dec. 7, 1999; PCT Application WO 99/08644, Shabty et al., published Feb. 25, 1999; U.S. Patent Application Publication No. 2002/0107461, Hui, published Aug. 8, 2002: and U.S. Patent Application Publication No. 2003/0233118, Hui, published Dec. 18, 2003. Preferred optimized ECP apparatus useful herein include the MC-2 and TS-3 enhanced optimized ECP therapy systems marketed by Vasomedical, Inc., Westbury, N.Y., U.S.A.

In a preferred embodiment, the methods of this invention also comprise monitoring the subject being treated with optimized ECP for one or more indicia of safety or efficacy. Such indicia include those pertaining to blood oxygen level, respiration rate, heart rate, and diagnostic indicators of heart failure including evaluation of symptoms such as dyspnea, orthonea, paroxysmal nocturnal dyspnea, chronic fatigue, peripheral edema, ascites, tachycardia, "galloping" heart rhythm, rales, jugular venous distention, and oliguria; chest x-ray to assess the size of the heart; electrocardiogram, preferably with Doppler interrogation; radionuclide ventriculogram; coronary angiography; and magnetic resonance imaging.

A preferred monitoring step comprises monitoring of the subject's blood oxygen level. Such monitoring may be conducted through oximetry methods among those known in the art. Monitoring may be through devices incorporated into the optimized ECP apparatus, or otherwise. In a preferred embodiment, oximeters function by measuring the oxygen saturation (the amount of oxygenated hemoglobin as a percentage of total hemoglobin) in arterial blood. In general, methods for measuring oxygen saturation utilize the relative difference between the light absorption (or attenuation) coefficient of oxygenated hemoglobin and that of reduced hemoglobin. The light absorption coefficient for oxygenated hemoglobin and reduced hemoglobin is dependent on the wavelength of the light traveling through them. Oxygenated hemoglobin and reduced hemoglobin have different light absorption coefficients with wavelengths in the red and infrared regions. Thus, the two colors typically chosen to shine through the blood sample are red light and infrared light. In oximeters, light intensity is measured at various physiological states created by the pulsing of the vasculature as blood flows. As the heart beats, arterial blood is forced in the arteries and capillaries to produce a blood filled state. The blood then drains leaving a reference which consists of tissue, bone and some amount of venous blood. The collected transmitted light is subjected to photoelectric conversion and then mathematical conversion to eventually calculate the degree of oxygen saturation in the blood.

In a preferred embodiment, non-invasive oximeters are used to measure oxygen saturation. Oximeters function by passing light of various colors or wavelengths through a sample. On the human body, typical measuring points are the tip of a finger or an ear lobe. The oximeter determines $SpO_2$ and pulse rate by passing two wavelengths of low intensity light, one red and one infrared, through body tissue to a photodetector. The sample absorbs the transmitted light to varying degrees relative to the particular constituents through which the light passes. A photosensitive device, such as a photo multiplier tube or photodiode, is used to detect the transmitted light. Alternatively, the photosensitive device can be designed to detect the light reflected from the sample. During measurement, the signal strength resulting from each light source depends on the color and thickness of the body tissue, the sensor placement, the intensity of the light sources, and the absorption of the arterial and venous blood (including the time varying effects of the pulse) in the body tissues. Either system provides a measure of the light the sample absorbs, i.e., the light the sample does not transmit or reflect. Using measurements of the transmitted light intensity, the absorption of light by the sample can be calculated. The oximeter processes these signals, separating the time invariant parameters (tissue thickness, skin color, light intensity, and venous blood) from the time variant parameters (arterial volume and SpO2) to identify the pulse rate and calculate oxygen saturation.

A low oxygen saturation measurement is a warning of dangerous oxygen deprivation, or hypoxemia, a potential cause of injury or death. The specific minimum safe blood oxygen level is determined according to sound medical practice. In one method, the minimum blood oxygen circulating percentage is about eighty-six (86) percent, preferably less than about ninety (90) percent. In another method, the minimum level is a blood oxygen circulation percentage level that is about five (5) percentage points (on an absolute basis) less than the subject's blood oxygen level prior to initiation of an optimized ECP treatment session. In one embodiment, therapy is terminated if the blood oxygen level drops below the minimum level. In another method, the oximeter or optimized ECP apparatus provides the service provider with a visual or audible notification that the minimum level has been reached.

A preferred method includes (1) providing a plurality of inflatable devices adapted to be received about the lower extremities of said subject; (2) interconnecting a source of compressed fluid with said inflatable devices; (3) interconnecting a fluid distribution assembly with said inflatable devices and said source of compressed fluid; (4) distributing compressed fluid from said source of compressed fluid to said inflatable devices; (5) providing a controller in communication with said fluid distribution assembly; (6) inflating and deflating said inflatable devices using said controller so as to minimize end diastolic pressure, whereby an increased cardiac output in said subject is achieved; (7) measuring the oxygen level in the blood of said subject; and (8) providing a warning or (preferably) terminating said inflating and deflating of the inflatable devices if said oxygen level drops below a safe level. In another embodiment, said inflating and deflating step is performed so as to maximize systolic unloading and diastolic augmentation. Preferably, the inflating and deflating step is performed so as to minimize end diastolic pressure and maximize systolic unloading and diastolic augmentation.

In a preferred embodiment, an optimized ECP apparatus comprises a device for measuring blood oxygen level. Preferably in such a device, the optimized ECP apparatus includes a controller that monitors the blood oxygen level and determines if it falls below a safe level determined pursuant to sound medical practice, as discussed above. Such a level may be set by the service provider, or be automatically determined by the optimized ECP apparatus. In one embodiment, the controller terminates therapy if the blood oxygen levels falls below the safe level. In another embodiment, the controller provides a visual or audible signal to the service provider.

The examples and other embodiments described herein are exemplary and not intended to be limiting in describing the full scope of compositions and methods of this invention. Equivalent changes, modifications and variations of specific embodiments, materials, compositions and methods may be made within the scope of the present invention, with substantially similar results.

What is claimed is:

1. A method of increasing cardiac output in a patient, comprising:

providing a plurality of inflatable devices adapted to be received about the lower extremities of the patient;

interconnecting a source of compressed fluid with said inflatable devices;

interconnecting a fluid distribution assembly with said inflatable devices and said source of compressed fluid;

distributing compressed fluid from said source of compressed fluid to said inflatable devices;

providing a controller in communication with said fluid distribution assembly;

controlling inflation and deflation of said inflatable devices by said controller; and adjusting a deflation time of said inflatable devices to minimize end diastolic pressure by incrementally decreasing said deflation time until no change in end diastolic pressure is detected, and subsequently increasing said deflation time by one increment until the lowest end diastolic pressure is achieved with the latest deflation time.

2. A method of claim 1, further comprising the step of controlling said deflation of said inflatable devices without compromising venous return.

3. A method of claim 1, further comprising the step of controlling said deflation of said deflatable devices to minimize energy spent in ventricular isovolumetric contraction.

4. A method of claim 1, further comprising the step of providing communication between said controller and a remote monitor.

5. A method of claim 4, further comprising the step of monitoring one or more indicia of safety or efficacy.

6. A method of claim 5, wherein said one or more indicia of safety or efficacy is selected from a group comprising: blood pressure, blood flow, finger plethmysography waveform, external applied pressure, electrocardiogram, apparatus operational parameters, blood oxygen level, respiration rate, heart rate, and diagnostic indicators.

7. A method of controlling an external counterpulsation apparatus for treating a patient, the method comprising:

providing a proximal inflatable device and a distal inflatable device;

providing a source of compressed fluid in communication with said proximal inflatable device and said distal inflatable device;

interconnecting a fluid distribution assembly with said proximal inflatable device, said distal inflatable device, and said source of compressed fluid for distributing compressed fluid from said source of compressed fluid to said proximal inflatable device and said distal inflatable device;

controlling said fluid distribution assembly to trigger inflation and deflation of said inflatable devices based on an approximated aortic valve closure; and inflating said distal inflatable device when a pulse generated by application of an external pressure by said proximal inflatable device in compressing the vascular bed travels up the arterial tree and reaches the root of the aorta at approximately 25 to 50 percent of a pulse amplitude from end diastole to peak systole in a descending portion of the systolic waveform.

8. A method of claim 7, wherein a proximal inflation device is inflated beginning at a time delay after said distal inflatable device corresponding to a length of time that a peak of the pulse generated by inflating said distal inflatable device travels up the arterial tree and reaches a midpoint of said proximal inflatable device.

9. A method of claim 7, further comprising the step of providing communication between said controller and a remote monitor.

10. A method of claim 9, further comprising the step of monitoring one or more indicia of safety or efficacy.

11. A method of claim 10, wherein said one or more indicia of safety or efficacy is selected from a group comprising: blood pressure, blood flow, finger plethmysography waveform, external applied pressure, electrocardiogram, apparatus operational parameters, blood oxygen level, respiration rate, heart rate, and diagnostic indicators.

12. An external counterpulsation apparatus comprising:

a plurality of inflatable devices;

a source of compressed fluid in communication with said plurality of inflatable devices;

a fluid distribution assembly distributing compressed fluid from said source of compressed fluid to said inflatable devices; and a controller in communication with said fluid distribution assembly and controlling inflation and deflation of said inflatable devices, said controller adjusting said deflation of said inflatable devices to minimize end diastolic pressure by incrementally decreasing a deflation time until no change in end diastolic pressure is detected, and subsequently increasing said deflation time by one increment until the lowest end diastolic pressure is achieved with the latest deflation time.

13. An apparatus according to claim 12, wherein said controller controls said deflation of said inflatable devices to minimize energy spent in ventricular isovolumetric contraction whereby said increased cardiac output is achieved.

14. An apparatus according to claim 12, wherein said plurality of inflatable devices are adapted to maximize the application of pressure to a peripheral area of the lower extremities of the patient.

15. An apparatus according to claim 14, further comprising a sensor for monitoring one or more indicia of safety or efficacy, said sensor in communication with said controller.

16. An apparatus according to claim 15, wherein said one or more indicia of safety or efficacy is selected from a group comprising: blood pressure, blood flow, finger plethmysography waveform, external applied pressure, electrocardiogram, apparatus operational parameters, blood oxygen level, respiration rate, heart rate, and diagnostic indicators.

17. An apparatus according to claim 16, wherein said sensor is an oximeter.

* * * * *